US011701626B2

(12) United States Patent
Pappalardo et al.

(10) Patent No.: US 11,701,626 B2
(45) Date of Patent: Jul. 18, 2023

(54) STATIC MIXER WITH A TRIANGULAR MIXING CONDUIT

(71) Applicant: NORDSON CORPORATION, Westlake, OH (US)

(72) Inventors: Matthew E. Pappalardo, Robbinsville, NJ (US); Laura Manfre, Robbinsville, NJ (US)

(73) Assignee: Nordson Corporation, Westlake, OH (US)

( * ) Notice: Subject to any disclaimer, the term of this patent is extended or adjusted under 35 U.S.C. 154(b) by 594 days.

(21) Appl. No.: 16/629,192

(22) PCT Filed: Jul. 10, 2018

(86) PCT No.: PCT/US2018/041393

§ 371 (c)(1),
(2) Date: Jan. 7, 2020

(87) PCT Pub. No.: WO2019/014181

PCT Pub. Date: Jan. 17, 2019

(65) Prior Publication Data

US 2020/0222864 A1 Jul. 16, 2020

Related U.S. Application Data

(60) Provisional application No. 62/531,558, filed on Jul. 12, 2017.

(51) Int. Cl.
*B01F 5/06* (2006.01)
*B01F 13/00* (2006.01)
(Continued)

(52) U.S. Cl.
CPC .. *B01F 25/43151* (2022.01); *B01F 33/50112* (2022.01)

(58) Field of Classification Search
CPC ..... B01F 25/432; B01F 25/43151
See application file for complete search history.

(56) References Cited

U.S. PATENT DOCUMENTS 3,942,765 A 3/1976 Henrickson
3,949,970 A 4/1976 ter Braak
(Continued)

FOREIGN PATENT DOCUMENTS

CN 1138001 A 12/1996
CN 1683063 A 10/2005
(Continued)

*Primary Examiner* — Elizabeth Insler
(74) *Attorney, Agent, or Firm* — BakerHostetler

(57) ABSTRACT

A static mixer 10 for mixing a fluid flow having at least two components is disclosed, as well as a method for mixing first and second components with the static mixer 10. The static mixer 10 includes a mixing conduit 20 having a first inner surface 38*a*, a second inner surface 38*b* that extends from the first inner surface 38*a*, and a third inner surface 38*c* that extends from the first inner surface 38*a* to the second inner surface 38*b*. The first, second, and third inner surfaces 38*a*, 38*b*, 38*c* define a mixing passage receiving the fluid flow. The first and second inner surfaces 38*a*, 38*b* are offset by a first acute angle, the first and third surfaces 38*a*, 38*c* are offset by a second acute angle, and the second and third surfaces 38*b*, 38*c* are offset by a third acute angle. The static mixer 10 includes a mixing element 100 positioned in the mixing passage.

21 Claims, 15 Drawing Sheets

(51) Int. Cl.
*B01F 25/431* (2022.01)
*B01F 33/501* (2022.01)

(56) References Cited

U.S. PATENT DOCUMENTS

| | | | | |
|---|---|---|---|---|
| 3,977,657 | A * | 8/1976 | Shearer | B01F 25/4314 366/341 |
| 4,874,249 | A | 10/1989 | Kabatek et al. | |
| 5,104,233 | A | 4/1992 | Kojima | |
| 2003/0048694 | A1 | 3/2003 | Horner et al. | |
| 2012/0104044 | A1* | 5/2012 | Pappalardo | B01F 33/50112 222/137 |
| 2013/0142008 | A1 | 6/2013 | Nomura et al. | |

FOREIGN PATENT DOCUMENTS

| | | | |
|---|---|---|---|
| CN | 1720094 | A | 1/2006 |
| CN | 101601979 | A | 12/2009 |
| CN | 101722616 | A | 6/2010 |
| CN | 102029121 | A | 4/2011 |
| CN | 102389727 | A | 3/2012 |
| CN | 103585908 | A | 2/2014 |
| CN | 103769321 | A | 5/2014 |
| DE | 0694473 | C | 8/1940 |
| DE | 202009004577 | U1 | 7/2009 |
| EP | 2301656 | A2 | 3/2011 |
| FR | 2209601 | A2 | 7/1974 |
| GB | 1386955 | A | 3/1975 |
| JP | 64-022329 | A | 1/1989 |
| JP | 02-095424 | A | 4/1990 |
| JP | 2013-119047 | A | 6/2013 |
| NL | 7212536 | A | 3/1973 |
| WO | 2017/083737 | A1 | 5/2017 |

* cited by examiner

STATIC MIXER WITH A TRIANGULAR MIXING CONDUIT

CROSS-REFERENCE TO RELATED APPLICATIONS

This application is the National Stage Application of International Patent Application No. PCT/US2018/041393, filed Jul. 10, 2018, which claims the benefit of U.S. Provisional Patent App. No. 62/531,558, filed Jul. 12, 2017, the disclosure of which is hereby incorporated by reference herein.

TECHNICAL FIELD

This disclosure generally relates to static mixers used for the mixing of two or more fluids, as well as related static mixer components.

BACKGROUND

Known static mixers include a mixer conduit that defines a passage and a mixing element comprised of a series of mixing baffles disposed within the passage. When two or more fluids are pumped into the static mixer, the flow of fluid along and around the non-moving mixing baffles continuously blends the fluids. The flow of fluids eventually forms a relatively homogenous mixture upon exiting the static mixer. This method of mixing is very effective for viscous materials in particular, such as epoxies, acrylics, and polyurethanes.

Several designs of static mixers currently exist. One type of static mixer currently used is a helical mixer. Helical mixers typically include a housing with a substantially circular cross section, and include mixing baffles of various designs that rotate the fluids to be mixed as the fluids flow through the helical mixer conduit. Helical mixers rely on the splitting and rotation of the fluids as they flow through the mixer conduit in order to double, and thus mix, the layers of fluids. Another type of static mixer currently used is a square multiflux mixer. Multiflux mixers generally mix material in a shorter length with less waste and less backpressure than an equivalent spiral mixer and are considered an advancement. As with helical mixers, the tube shape of multiflux mixers is critical to their mixing action. Multiflux mixers typically include a housing with a substantially square cross section, which, unlike helical mixers, causes no fluid rotation. In contrast, multiflux mixers rely on an even compressing and expanding of fluid layers using baffles disposed within the mixer conduit in order to double and mix the layers of fluid. As with spiral mixers, the fluid flows through multiflux mixers are divided into two flow paths. The flow paths are then compressed to opposite corners of the square tube. They then expand parallel to each other, which causes a doubling of the layers when the materials rejoin.

The mixing effectiveness of both helical mixers and square multiflux mixers is highly dependent on the geometry of their respective mixing conduits. For example, helical mixers' round housing geometry creates certain advantages due to its lack of corners, lack of straight walls, and curved wall shape, which encourages fluid rotation. A helical mixer in a straight wall housing, such as a square housing, does not work effectively because the flat sides of the housing impede rotation of the layers of fluid.

Multiflux mixers' rectangular housings have advantages due to their sets of two substantially parallel and straight walls, one in line with layer expansion and another aligned with the layer compression. The parallel straight walls encourage straight layers and impede undesirable layer rotation, while creating equidistant flow paths for fluid to reach across the length of the cross section of the mixer. A multiflux mixer geometry placed in a round tube does not allow for equal stretching and compression of layers, resulting in major streaking issues.

While the current mixing technology described above is effective at mixing high viscosity materials such as epoxies, acrylics, and polyurethanes, it is open to improvements to increase flow, reduce waste, and reduce size. Therefore, there is a need for a static mixer having a geometry that utilizes advantages provided by both helical mixers and square multiflux mixers. Harnessing the advantages of a new conduit geometry is the key in creating an advanced static mixer.

SUMMARY

An embodiment of the present application includes a static mixer for mixing a fluid flow having at least two components. The static mixer includes a mixing conduit defining an inner surface that comprises a first inner surface, a second inner surface that extends from the first inner surface, and a third inner surface that extends from the first inner surface to the second inner surface. The first, second, and third inner surfaces define a mixing passage configured to receive the fluid flow. The first and second inner surfaces are offset by a first acute angle, the first and third surfaces are offset by a second acute angle, and the second and third surfaces are offset by a third acute angle. The static mixer also includes a mixing element positioned in the mixing passage, where the mixing element is configured to contact the first, second, and third inner surfaces.

Another embodiment of the present application includes a method of mixing first and second components with a static mixer. The static mixer includes a mixing conduit and a mixing element that includes a first mixing baffle and a second mixing baffle downstream from the first mixing baffle. The method includes flowing the fluid flow through a first end of a mixing passage of the mixing conduit, where the mixing passage has a substantially triangular cross section, and flowing the fluid flow over a leading edge of the first mixing baffle to divide the fluid flow into at least two first portions. The method also includes flowing the at least two first portions of the fluid flow along the first mixing baffle to rotate the at least two first portions of the fluid flow in a first rotational direction within the mixing passage relative to a central axis defined by the mixing conduit, as well as recombining the at least two first portions at the trailing edge of the first mixing baffle, such that the at least two first portions form a first mixture. Further, the method includes flowing the first mixture over a leading edge of the second mixing baffle to divide the first mixture into at least two second portions, and flowing the at least two second portions of the first mixture along the second mixing baffle to rotate the at least two second portions of the first mixture in a second rotational direction that is opposite the first rotational direction within the mixing passage relative to the central axis. Additionally, the method includes recombining the at least two second portions of the first mixture at the trailing edge of the second mixing baffle, such that the at least two second portions of the first mixture form a second mixture.

BRIEF DESCRIPTION OF THE DRAWINGS

The foregoing summary, as well as the following detailed description, will be better understood when read in conjunction with the appended drawings. The drawings show illustrative embodiments of the invention. It should be understood, however, that the application is not limited to the precise arrangements and instrumentalities shown.

DETAILED DESCRIPTION OF ILLUSTRATIVE EMBODIMENTS

Figure 1:
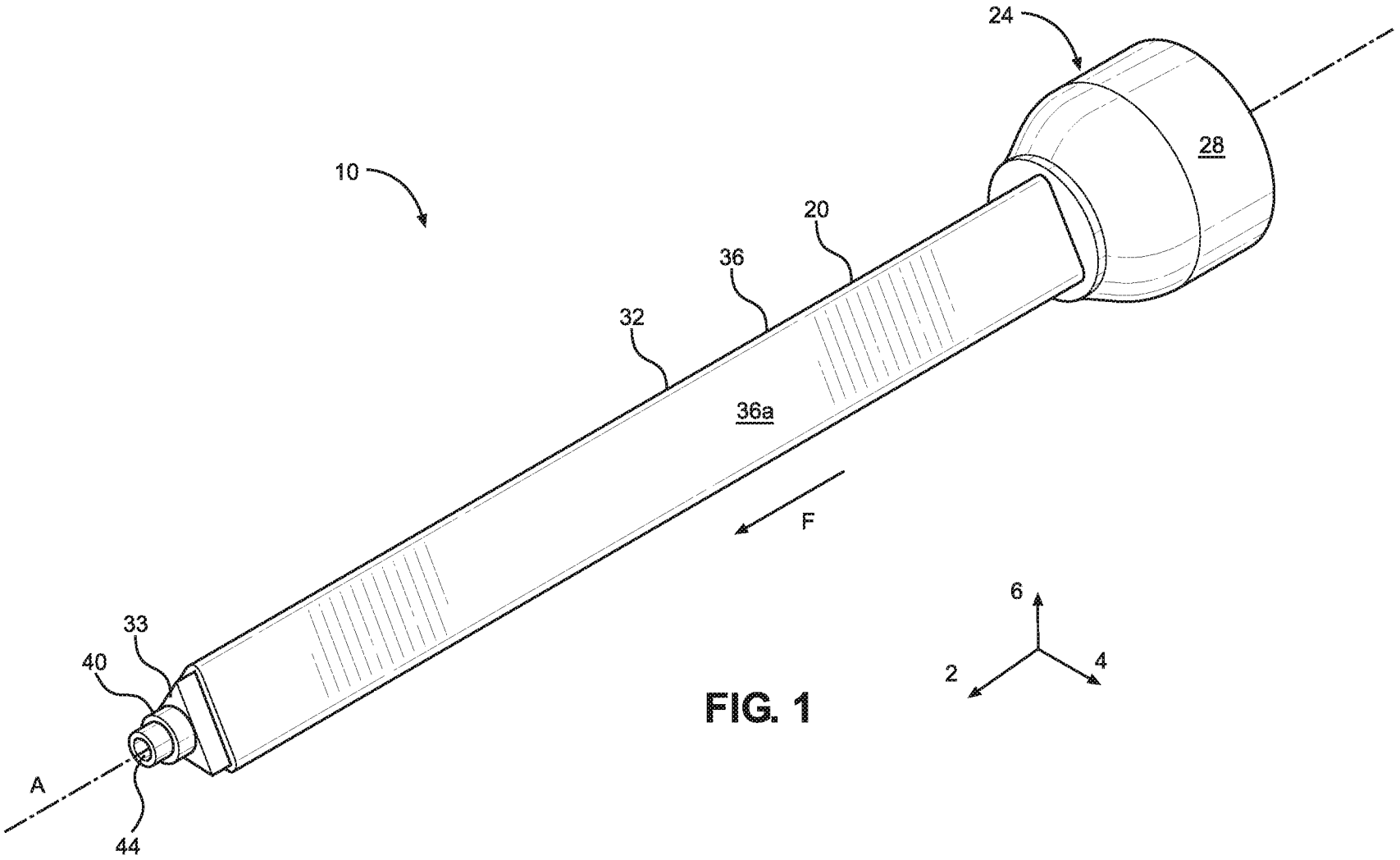
FIG. 1 is a perspective view of a static mixer according to an embodiment of the application.
Figure 2:
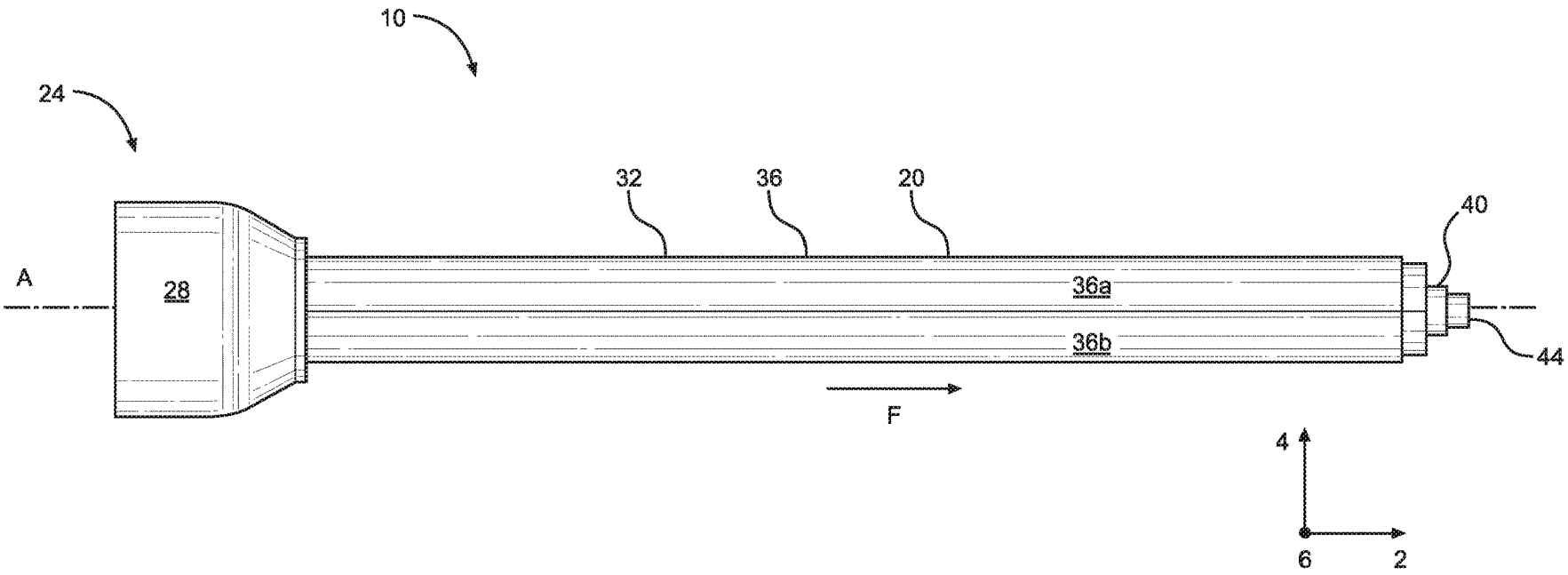
FIG. 2 is a side view of the static mixer shown in FIG. 1.
Figure 3:
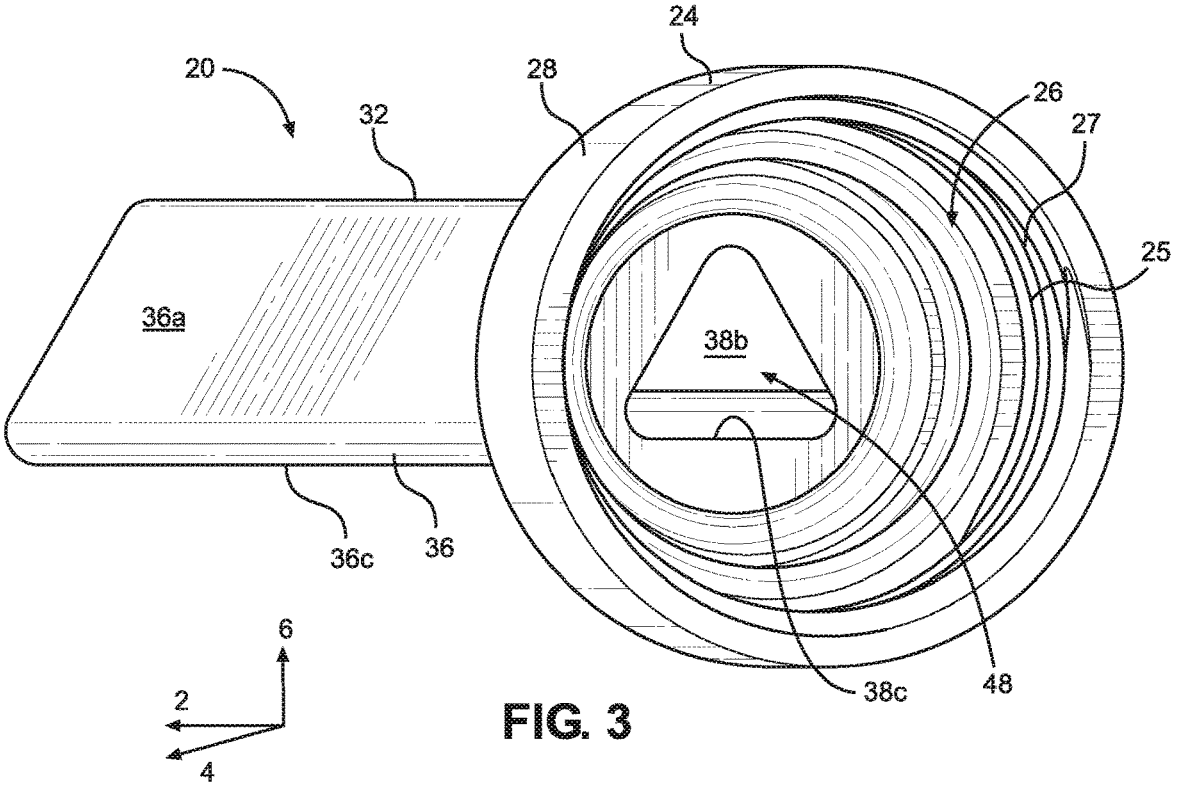
FIG. 3 is a rear perspective view of the static mixer shown in FIG. 1.

A static mixer 10 is disclosed that includes a mixing conduit 20 that defines a mixing passage 48. The mixing passage 48 is configured to receive a mixing element, such as the mixing element 100 or mixing element 300, where the mixing elements 100 and 300 are configured to mix two or more fluids flowing within the mixing passage 48.

Until now, a static mixer has yet to be developed that takes advantage of a triangular tube geometry. A triangle geometry is unique when compared to the geometry of a round or square tube. A triangular tube has three sides and three corners, which lend themselves to mixing geometries that cannot work in a round or square housing. As the advent of multiflux square mixers showed many benefits of a mixer designed for a square housing over helical mixers, it has been found through research and testing that mixing elements designed for use in a triangular tubes have higher flow rates with less material volume than square or round mixers.

Certain terminology is used to describe the static mixer 10 in the following description for convenience only and is not limiting. The words "right," "left," "lower," and "upper" designate directions in the drawings to which reference is made. The words "inner" and "outer" refer to directions toward and away from, respectively, the geometric center of the description to describe the static mixer 10 and related parts thereof. The words "forward" and "rearward" refer to directions in a longitudinal direction 2 and a direction opposite the longitudinal direction 2 along the static mixer 10 and related parts thereof. The terminology includes the above-listed words, derivatives thereof, and words of similar import.

Unless otherwise specified herein, the terms "longitudinal," "lateral," and "vertical" are used to describe the orthogonal directional components of various components of the static mixer 10, as designated by the longitudinal direction 2, lateral direction 4, and vertical direction 6. It should be appreciated that while the longitudinal and lateral directions 2 and 4 are illustrated as extending along a horizontal plane, and the vertical direction 6 is illustrated as extending along a vertical plane, the planes that encompass the various directions may differ during use.

Figure 4:
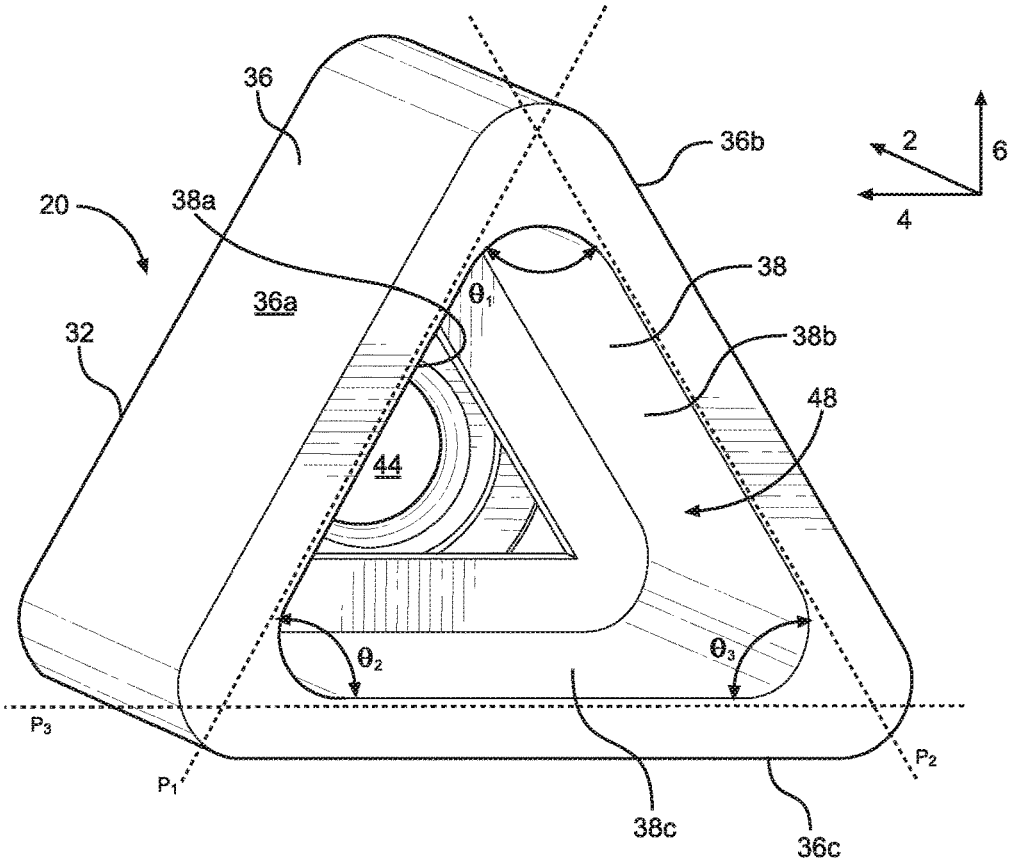
FIG. 4 is a cross-sectional view of the mixing conduit shown in FIG. 1 along a plane extending in the lateral and vertical directions.

Embodiments of the present application include a static mixer 10 for mixing two or more fluid flows into a homogenous fluid mixture. Referring to FIGS. 1-4, the static mixer 10 includes a mixing conduit 20 that is configured to receive a mixing element, such as mixing elements 100 or 300, which will be described further below. The mixing conduit 20 defines a socket 24, a nozzle 40, and a body section 32 that extends from the socket 24 to the nozzle 40 along a central axis A that is substantially parallel to the longitudinal direction 2. In one embodiment, the nozzle 40 extends out from a forward surface 33 defined by the body section 32. Alternatively, the forward surface 33 may not be present, and the body section may gradually taper into the nozzle 40. The socket 24 defines an outer surface 28, and may be substantially circular. The body section 32 also defines an outer surface 36 that extends from the socket 24 to the nozzle 40. The outer surface 36 includes a first outer surface 36*a*, a second outer surface 36*b* that extends from the first outer surface 36*a*, and a third outer surface 36*c* that extends from the first outer surface 36*a* to the second outer surface 36*b*. The intersections between the first outer surface 36*a*, the second outer surface 36*b*, and the third outer surface 36*c* may be curved or beveled, as shown in FIG. 4, or may define sharp angles. Further, the first, second, and third outer surfaces 36*a*, 36*b*, and 36*c* may be offset from each other with respect to the longitudinal direction 2 by an acute angle, such that the outer surface 36 defines a substantially triangular cross section. The nozzle 40 extends from the end of the body section 32, and defines an outlet 44, through which homogenous mixed fluid exits the static mixer 10.

Continuing with FIGS. 1-4, the body section 32 defines an inner surface 38, which defines a mixing passage 48 that extends from a socket opening 26 defined by the socket 24 to the outlet 44 defined by the nozzle 40. The socket 24 can also define a threading 27, which is capable of allowing the mixing conduit 20 to be releasably and securely coupled to a fluid storage container or pumping mechanism (not shown). However, the socket 24 may define a smooth inner surface 25 that is unthreaded in alternative embodiments. In operation, a mixing element, such as mixing elements 100 or 300, are configured to be received by the mixing passage 48, along with a flow of two or more fluids to be mixed. The inner surface 38 includes a first inner surface 38*a*, a second inner surface 38*b* that extends from the first inner surface 38*a*, and a third inner surface 38*c* extending from the first inner surface 38*a* to the second inner surface 38*b*. The first inner surface 38*a* extends substantially along a first plane $P_1$, the second inner surface 38*b* extends substantially along a second plane $P_2$, and the third inner surface 38*c* extends substantially along a third plane $P_3$. As such, each of the inner surfaces 38*a*-38*c* is depicted as having a substantially straight, planar configuration. The first, second, and third inner surfaces 38*a*, 38*b*, and 38*c* are configured such that the mixing passage 48 defines a substantially triangular shape. Accordingly, the first and second surfaces 38*a* and 38*b* (and thus the first and second planes $P_1$ and $P_2$) are offset by a first angle $\theta_1$, the first and third inner surfaces 38*a* and 38*c* (and thus the first and third planes $P_1$ and $P_3$) are offset by a second angle $\theta_2$, and the second and third surfaces 38*b* and 38*c* (and thus the second and third planes $P_2$ and $P_3$) are offset by a third angle $\theta_3$, where each of the first, second, and third angles $\theta_1$, $\theta_2$, and $\theta_3$, are acute angles. In one embodiment, each of the first, second, and third angles $\theta_1$, $\theta_2$, and $\theta_3$ are equal (60 degrees), such that the cross section of the mixing passage 48 defines an equilateral triangle along a plane defined by the lateral and vertical directions 4 and 6. However, the first, second, and third angles $\theta_1$, $\theta_2$, and $\theta_3$ can be altered as desired, so that the cross section of the mixing passage 48 defines an acute, isosceles, or obtuse triangle. Like the outer surface 28, the intersections of the first inner surface 38*a*, the second inner surface 38*b*, and the third inner surface 38*c* may be tapered or curved. Alternatively, the intersections of the first inner surface 38*a*, the second inner surface 38*b*, and the third inner surface 38*c* may define sharp angles.

The triangular cross section of the mixing passage 48 provides several advantages. Because the inner surface 38 of the mixing conduit 20 does not include perpendicular sides or corners, and further does not include any parallel sides, a mixing element (like the mixing elements 100 or 300, discussed below) can be used to cause the effective mixing of fluids through rotation as they pass through the mixing passage 48. This cannot be effectively achieved using a square multiflux mixer. Further, because the inner surface 38 includes straight walls, like a square multiflux mixer and unlike a helical mixer, the mixing passage 48 encourages straight layers in the fluid passing through the mixing conduit 20. These features in combination aid in creating new mixing geometries that were never possible with helical or square multiflux mixtures. These new mixing geometries help enable the creation of static mixers with higher flow rates than previously existing mixers that can be created using less material volume.

Now referring to FIGS. 5-8D, a mixing element 100 according to an embodiment of the present application will be described. The mixing element 100 is comprised of a plurality of mixing baffles 101. In particular, the mixing element 100 includes alternating arrangements of first mixing baffles 101*a* and second mixing baffles 101*b*, which may be mirror images of the first mixing baffles 101*a*. However, the mixing element 100 can be alternatively configured, such that a certain number of the first mixing baffles 101*a* and the second mixing baffles 101*b* repeat after each other. The mixing element 100 can be formed as a single unitary structure that defines each of the first and second mixing baffles 101*a* and 101*b*, such as through molding.

Figure 5:
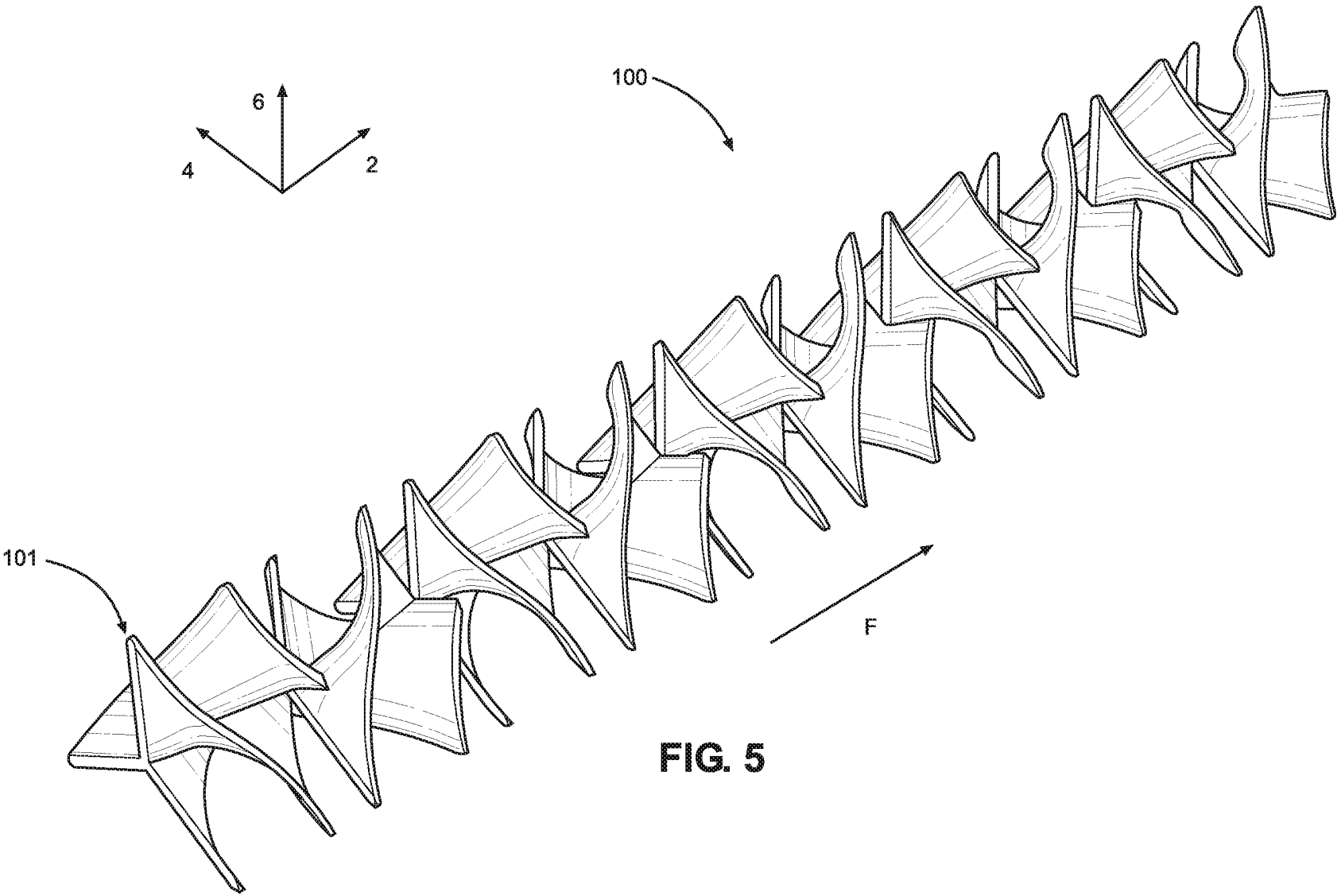
FIG. 5 is a perspective view of a mixing element according to an embodiment of the application.
Figure 6A:
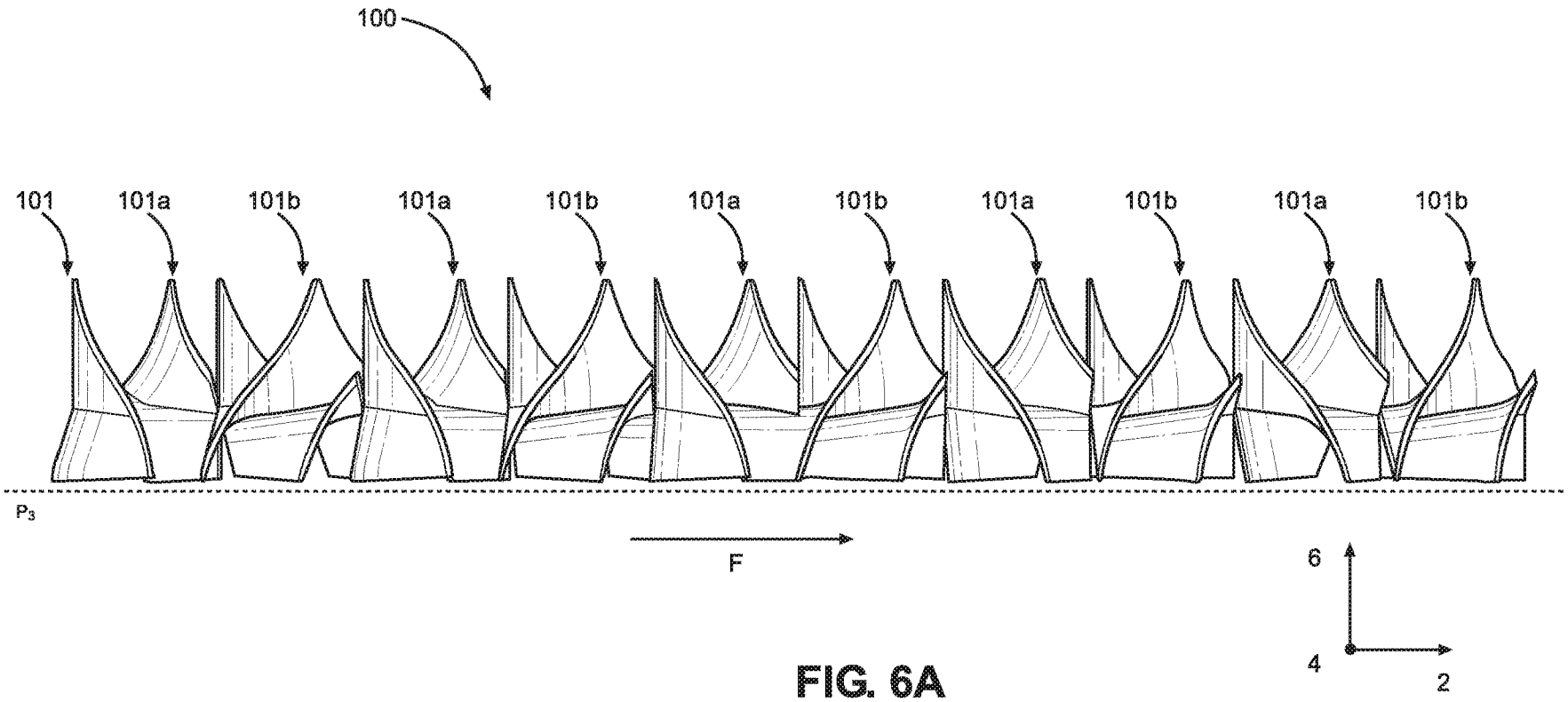
FIG. 6A is a side view of the mixing element shown in FIG. 5.

The mixing element 100 is configured such that two or more fluids are mixed as they flow through the mixing passage 48 of the mixing conduit 20, and along the mixing element 100. As shown in FIGS. 5 and 6A, the fluid flow extends along a direction F that is substantially parallel to the longitudinal direction 2 as the fluid flows from the first mixing baffle 101 in the mixing element 100, which may be a first or second mixing baffle 101*a* or 101*b*, to the last mixing baffle 101 in the mixing element 100, which may also be a first or second mixing baffle 101*a* or 101*b*. Each of the mixing baffles 101 divides the fluid flow through the mixing passage 48 at a leading edge of the mixing baffles 101, and then rotates, shifts, and/or expands the fluid flow before recombining the fluid flow at a trailing edge of the mixing baffles 101. In particular, the mixing baffles 101 generally divide the fluid flow into three portions through each of the mixing baffles 101 before recombining the fluid flow. As the fluid flow is being recombined at a trailing edge of a mixing baffle 101, the fluid flow may already have begun being separated by the leading edge of a subsequent mixing baffle 101, as the trailing edge of one mixing baffle may overlap along the longitudinal direction with the leading edge of a subsequent mixing baffle.

Figure 6B:
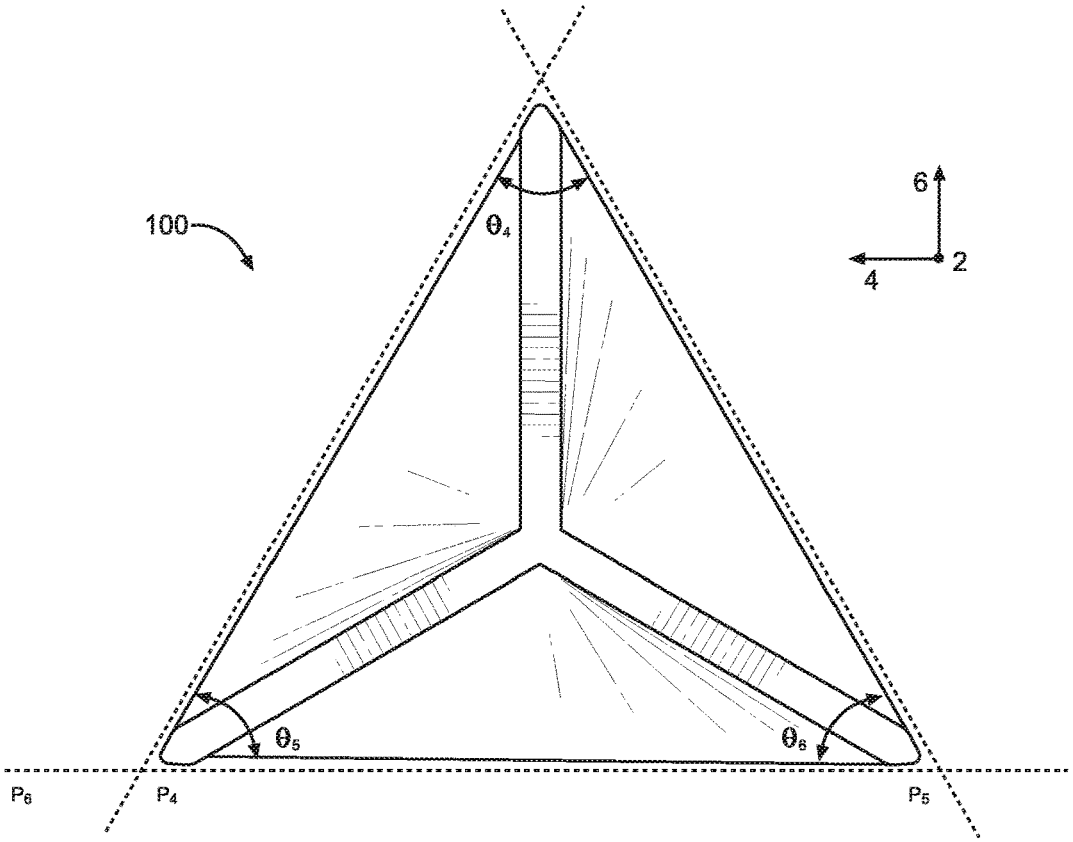
FIG. 6B is a front view of the mixing element shown in FIG. 5.
Figure 7A:
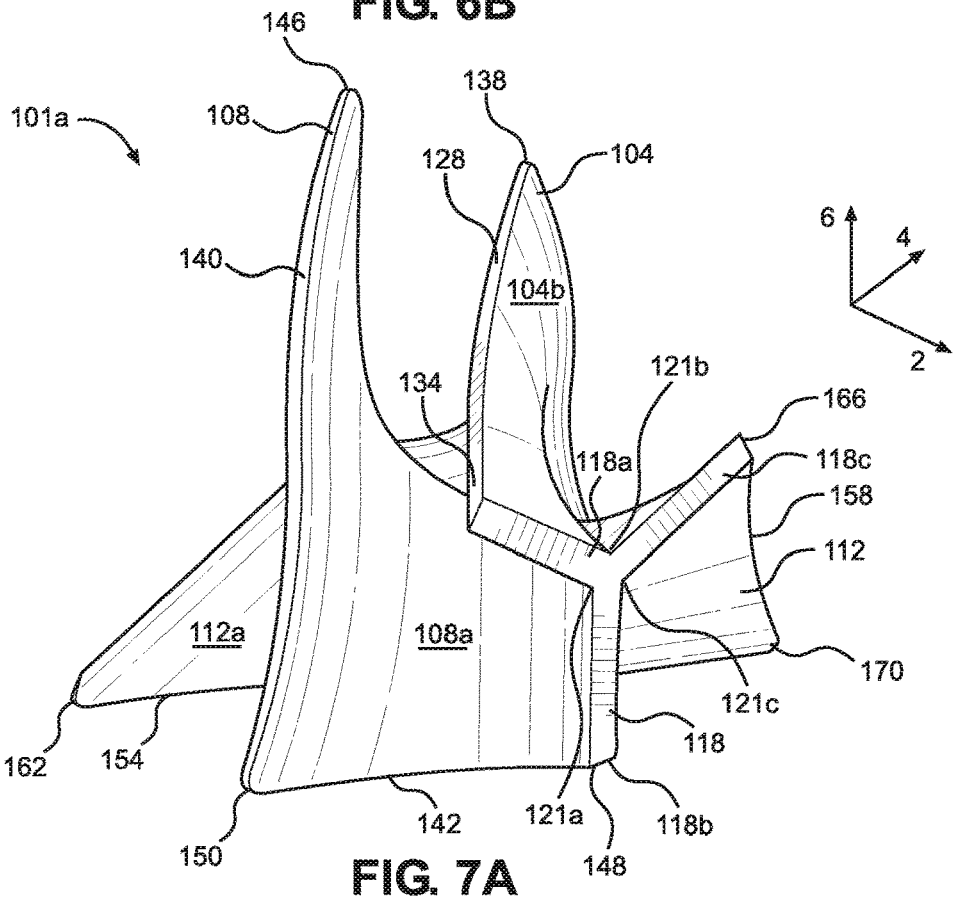
FIG. 7A is a right rear perspective view of a first mixing baffle shown in FIG. 6A.
Figure 7B:
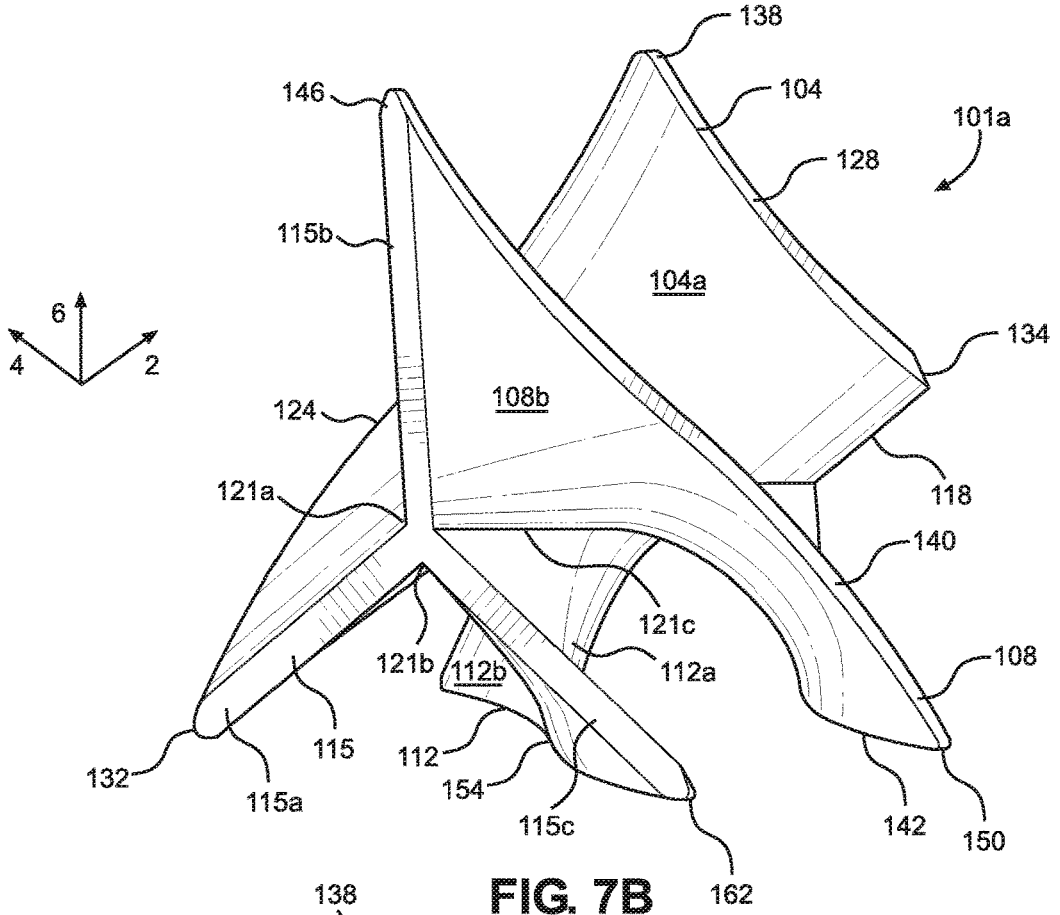
FIG. 7B is a right front perspective view of the first mixing baffle shown in FIG. 6A.
Figure 7C:
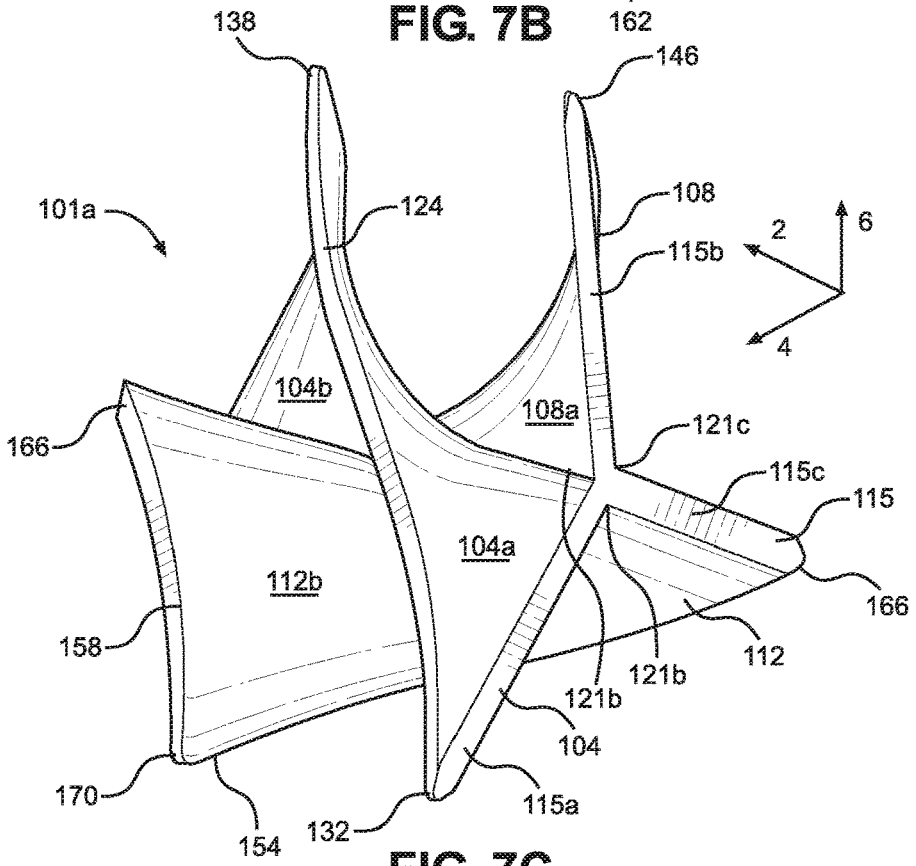
FIG. 7C is a left front perspective view of the first mixing baffle shown in FIG. 6A.
Figure 7D:
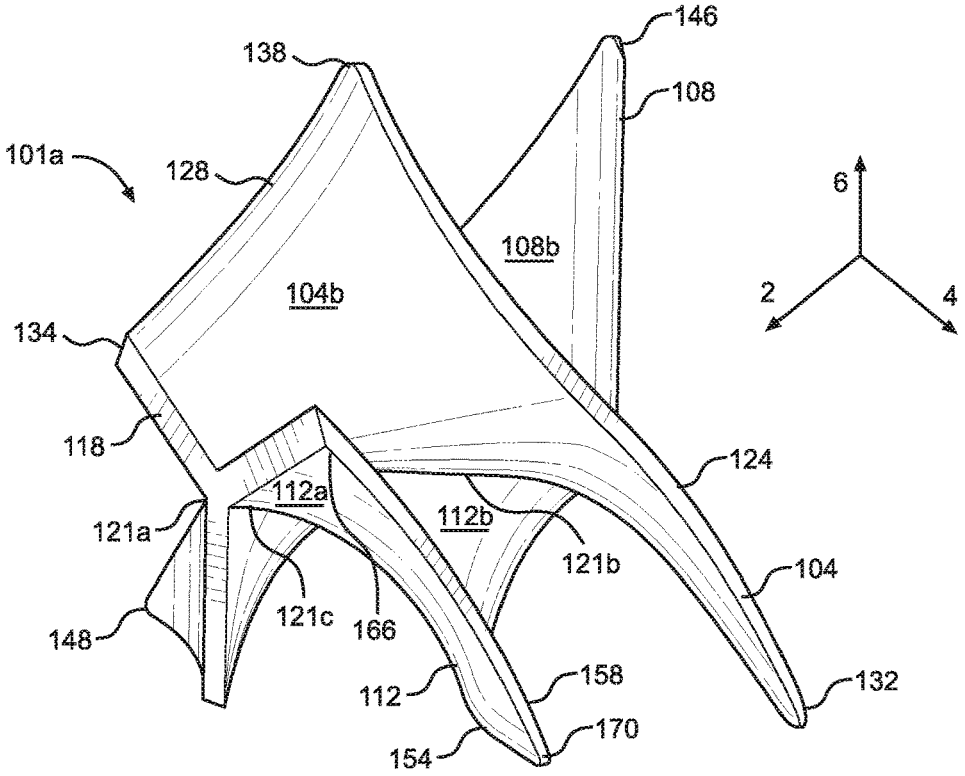
FIG. 7D is a left rear perspective view of the first mixing baffle shown in FIG. 6A.
Figure 8A:
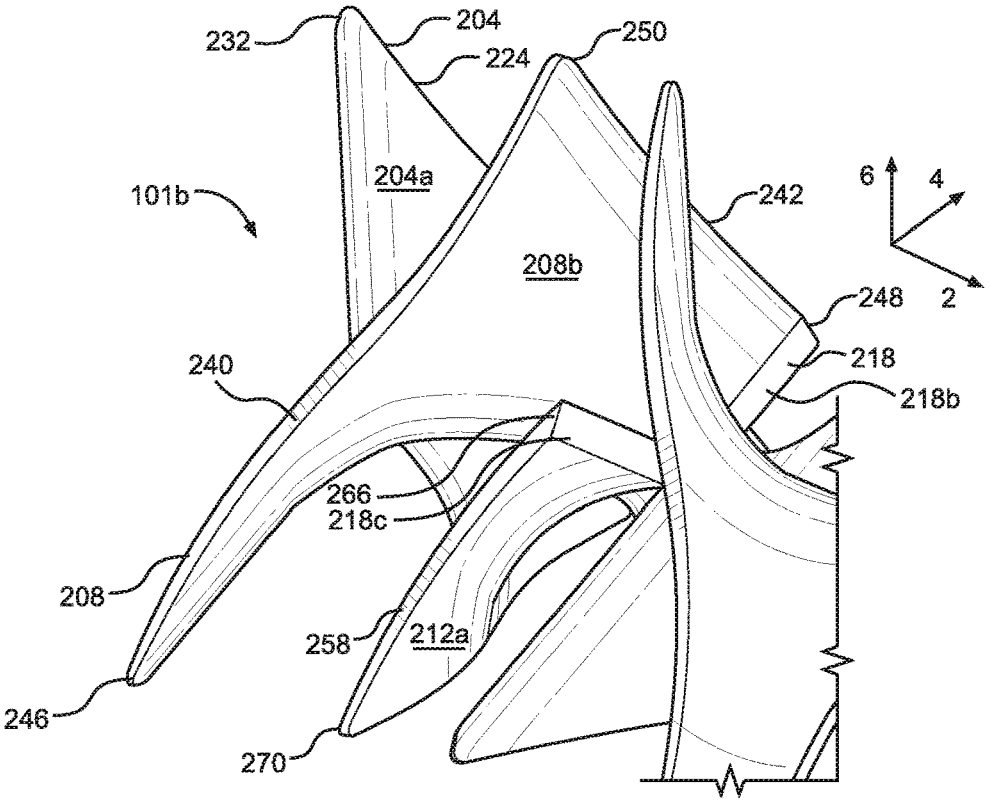
FIG. 8A is a right rear perspective view of a second mixing baffle shown in FIG. 6A.
Figure 8B:
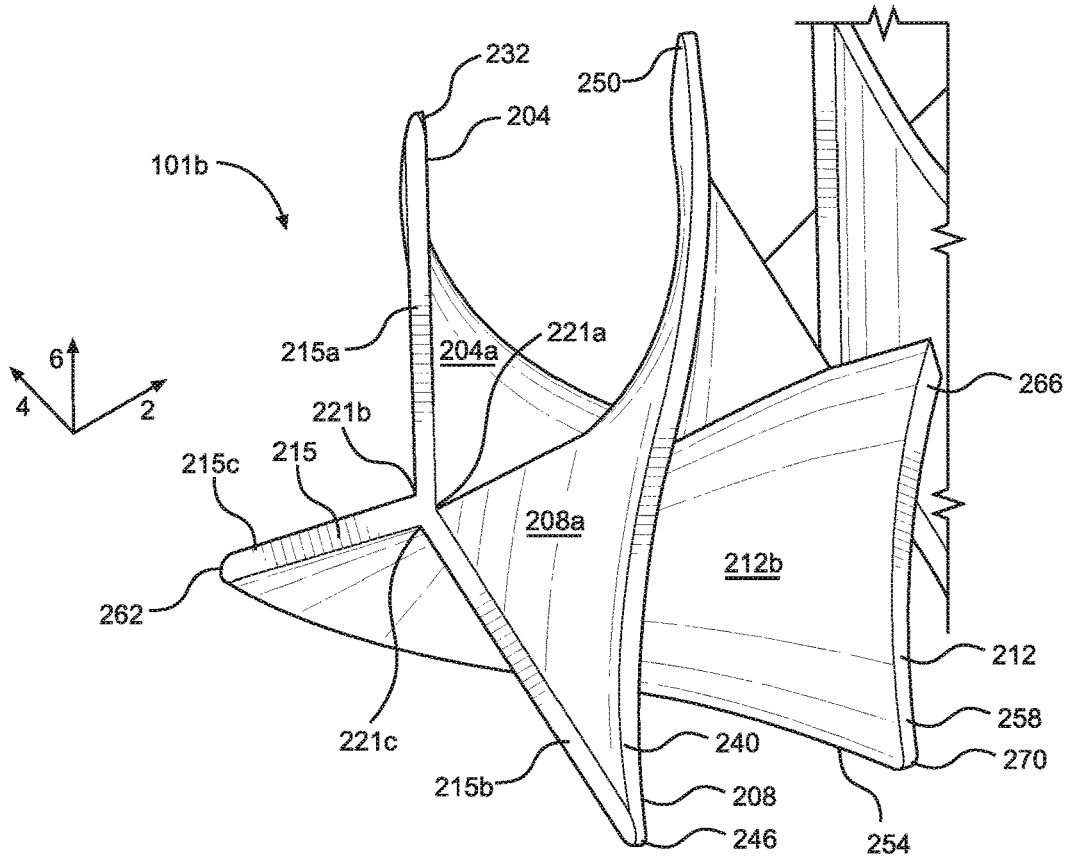
FIG. 8B is a right front perspective view of the second mixing baffle shown in FIG. 6A.
Figure 8C:
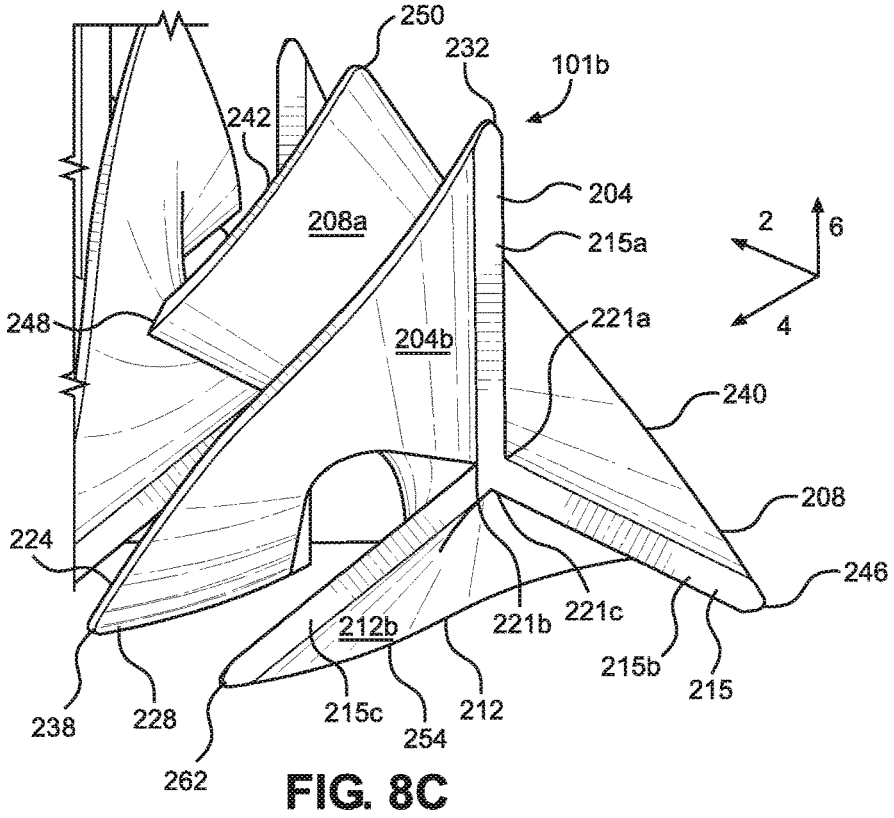
FIG. 8C is a left front perspective view of the second mixing baffle shown in FIG. 6A.
Figure 8D:
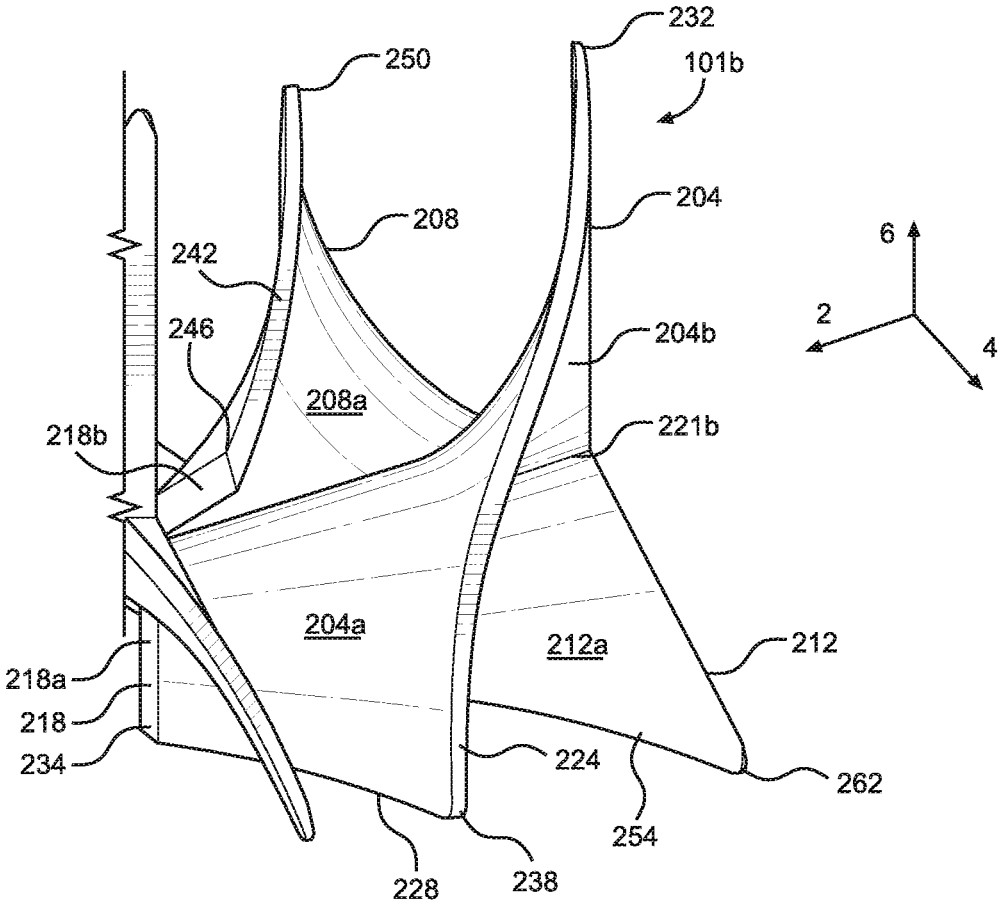
FIG. 8D is a left rear perspective view of the second mixing baffle shown in FIG. 6A.

Like the mixing passage 48 of the mixing conduit 20, the mixing element 100 can define a triangular cross section when viewed from a plane that extends in the lateral and vertical directions 4 and 6, as shown in FIG. 6B. The profile of the mixing element 100 when viewed from this plane can be defined by a first plane $P_4$, a second plane $P_5$, and a third plane $P_6$. The first plane $P_4$ of the mixing element 100 can be offset from the second plane $P_5$ by a first angle $\theta_4$, the first plane $P_4$ may be offset from the third plane $P_6$ by a second angle $\theta_5$, and the second plane $P_5$ may be offset from the third plane $P_6$ by a third angle $\theta_6$. Each of the first, second, and third angles $\theta_4$, $\theta_5$, and $\theta_6$ can be equal (as shown in FIG. 6B), in which case each of the first, second, and third angles $\theta_4$, $\theta_5$, and $\theta_6$ are 60 degrees. Alternatively, the first, second, and third angles $\theta_4$, $\theta_5$, and $\theta_6$ can be altered as desired, so that the cross section of the mixing element 100 can define an acute, isosceles, or obtuse triangle. Regardless of the type of triangle formed by the cross section of the mixing element 100, the mixing element 100 will generally conform in cross-sectional shape to the cross-sectional shape of the mixing passage 48, such that the mixing element 100 can be received in the mixing passage 48 of the mixing conduit 20. As a result, when the mixing element 100 is disposed within the mixing passage 48, the first plane $P_1$ of the mixing conduit 20 can be parallel to the first plane $P_4$ of the mixing element 100, the second plane $P_2$ of the mixing conduit 20 can be parallel to the second plane $P_5$ of the mixing element 100, and the third plane $P_3$ of the mixing conduit 20 can be parallel to the third plane $P_6$ of the mixing element 100. However, the mixing element 100 may be rotated relative to the mixing conduit 20 such that the mixing element 100 may be inserted into the mixing passage 48 in other orientations, in which case different ones of the first through third planes $P_1$-$P_3$ of the mixing conduit 20 will be parallel to different ones of the first through third planes $P_4$-$P_6$ of the mixing element 100.

Continuing with FIGS. 7A-7D, the first mixing baffle 101*a* will be described. The features of the first mixing baffle 101*a* as described below can be equally representative of each of the first mixing baffles 101*a* present throughout the length of the mixing element 100. The first mixing baffle 101*a* defines a first mixing panel 104, a second mixing panel 108, and a third mixing panel 112, each of which extends from a leading edge 115 of the first mixing baffle 101*a* to a trailing edge 118 of the first mixing baffle 101*a*. Each of the first, second, and third mixing panels 104, 108, and 112 can be curved along the longitudinal direction 2 and may substantially form rectangular prisms if flattened into a uniform plane. However, this is not intended to be limiting, and the first, second, and third mixing panels 104, 108, and 112 can form alternative shapes as desired. Each of the first, second, and third mixing panels 104, 108, and 112 can define a portion of the leading edge 115. For example, the first mixing panel 104 can define a first portion 115*a* of the leading edge 115, the second mixing panel 108 can define a second portion 115*b* of the leading edge 115, and the third mixing panel 112 can define a third portion 115*c* of the leading edge 115. Additionally, each of the first, second, and third mixing panels 104, 108, and 112 can define a portion of the trailing edge 118. For example, the first mixing panel 104 can define a first portion 118*a* of the trailing edge 118, the second mixing panel 108 can define a second portion 118*b* of the trailing edge 118, and the third mixing panel 112 can define a third portion 118*c* of the trailing edge 118. Though the leading and trailing edges 115 and 118 are depicted as substantially planar surfaces, the leading and trailing edges 115 and 118 can also be alternatively configured as desired. For example, the leading and trailing edges 115 and 118 can be beveled, curved, define sharp edges, etc.

Each of the mixing panels 104, 108, and 112 are integrally connected to each other. The first mixing panel 104 and the second mixing panel 108 connect at a first junction 121*a*, the first mixing panel 104 and the third mixing panel 112 can connect at a second junction 121*b*, and the second mixing panel 108 and the third mixing panel 112 connect at a third junction 121*c*. While each of the first, second, and third junctions 121*a*, 121*b*, and 121*c* are depicted as sharp angles between the mixing panels 104, 108, and 112, the junctions 121*a-c* may be substantially curved, such that the transition from one of the mixing panels 104, 108, or 112 to another of the mixing panels 104, 108, o 112 is gradual.

The first mixing panel 104 defines a first surface 104*a* and a second surface 104*b* opposite the first surface 104*a*. The first and second surfaces 104*a* and 104*b* are dimensionally the largest of the first mixing panel 104, and define the regions of the first mixing panel 104 that contact the flow of fluid to rotate it as it flows through the mixing passage 48. The first mixing panel 104 also defines multiple side surfaces that extend between the first and second surfaces 104*a* and 104*b*. The first portion 115*a* of the leading edge 115 extends from the first surface 104*a* to the second surface 104*b* at a forward-most part of the first mixing panel 104, and the first portion 118*a* of the trailing edge 118 extends from the first surface 104*a* to the second surface 104*b* at a rearward-most part of the first mixing panel 104. Between the leading and trailing edges 115 and 118, the first mixing panel 104 defines a first side 124 and a second side 128. The first side 124 of the first mixing panel 104 extends from the first portion 115*a* of the leading edge 115 to the second side 128, and the second side 128 extends from the first side 124 to the first portion 118*a* of the trailing edge 118. Both the first and second sides 124 and 128 also extend from the first surface 104*a* to the second surface 104*b*. Though the first and second sides 124 and 128 are shown as substantially planar surfaces, the first and second sides 124 and 128 can be alternatively configured as desired. For example, the first and second sides 124 and 128 can be beveled, curved, define sharp edges, etc.

The sides of the first mixing panel 104 are configured to meet at respective corners. The first portion 115*a* of the leading edge 115 is configured to meet the first side 124 of the first mixing panel 104 at a first corner 132, the second side 128 of the first mixing panel 104 is configured to meet the first portion 118*a* of the trailing edge 118 at a second corner 134, and the first and second sides 124 and 128 of the first mixing panel 104 are configured to meet at a third corner 138. Due to the curvature of the first mixing panel 104, which will be discussed further below, the first corner 132 is positioned forward along the longitudinal direction 2 and to the left along the lateral direction 4 with respect to the second and third corners 134 and 138, and the second corner 134 is positioned rearward along the longitudinal direction 2 and to the right along the lateral direction 4 with respect to the first and third corners 132 and 138. Additionally, the first corner 132 is positioned below the second and third corners 134 and 138 along the vertical direction 6, while the third corner 138 is positioned above the first and second corners 132 and 134 along the vertical direction 6.

The second mixing panel 108 can be similarly configured as the first mixing panel 104. The second mixing panel 108 also defines a first surface 108*a* and a second surface 108*b* opposite the first surface 108*a*. The first and second surfaces 108*a* and 108*b* of the second mixing panel 108 are dimensionally the largest, and define regions of the second mixing panel 108 that contact the flow of fluid to rotate the fluid as it flows through the mixing passage 48. The second mixing panel 108 further defines multiple side surfaces that extend between the first and second surfaces 108*a* and 108*b*. Like the first mixing panel 104, the second portion 115*b* of the leading edge 115 extends from the first surface 108*a* of the second mixing panel 108 to the second surface 108*b* at a forward-most part of the second mixing panel 108, and the second portion 118*b* of the trailing edge 118 extends from the first surface 108*a* to the second surface 108*b* at a rearward-most part of the second mixing panel 108. Between the leading and trailing edges 115 and 118, the second mixing panel 108 defines a first side 140 and a second side 142. The first side 140 of the second mixing panel 108 extends from the second portion 115*b* of the leading edge 115 to the second side 142, and the second side 142 extends from the first side 140 to the second portion 118*b* of the trailing edge 118. Both the first and second sides 140 and 142 also extend from the first surface 108*a* to the second surface 108*b*. Though the first and second sides 140 and 142 are shown as substantially planar surfaces, the first and second sides 140 and 142 can be alternatively configured as desired. For example, the first and second sides 140 and 142 can be beveled, curved, define sharp edges, etc.

The sides of the second mixing panel 108 are configured to meet at respective corners. The second portion 115*b* of the leading edge 115 is configured to meet the first side 140 of the second mixing panel 108 at a first corner 146, the second side 142 of the second mixing panel 108 is configured to meet the second portion 118*b* of the trailing edge 118 at a second corner 148, and the first and second sides 140 and 142 of the second mixing panel 108 are configured to meet at a third corner 150. Due to the curvature of the second mixing panel 108, which will be discussed further below, the first corner 146 is positioned forward along the longitudinal direction 2 with respect to the second and third corners 148 and 150, the second corner 148 is positioned rearward along the longitudinal direction 2 with respect to the first and third corners 146 and 150, and the first and second corners 146 and 148 are not spaced apart along the lateral direction 4. Additionally, the first corner 146 is positioned above the second and third corners 148 and 150, while the second and third corners 148 and 150 are not spaced apart along the vertical direction 6. The third corner 150 is positioned to the right of the first and second corners 146 and 148 along the lateral direction 4.

The third mixing panel 112 can be similarly configured as the first and second mixing panels 104 and 108. The third mixing panel 112 also defines a first surface 112*a* and a second surface 112*b* opposite the first surface 112*a*. The first and second surfaces 112*a* and 112*b* of the third mixing panel 112 are dimensionally the largest of the surfaces of the third mixing panel 112, and define the regions of the third mixing panel 112 that contact the flow of fluid to rotate the flow of fluid as it flows through the mixing passage 48. The third mixing panel 112 further defines multiple side surfaces that extend between the first and second surface 112*a* and 112*b*. Like the first and second mixing panels 104 and 108, the third portion 115*c* of the leading edge 115 extends from the first surface 112*a* to the second surface 112*b* of the third mixing panel 112 at a forward-most part of the third mixing panel 112, and the third portion 118*c* of the trailing edge 118 extends from the first surface 112*a* to the second surface 112*b* at a rearward-most part of the second mixing panel 112. Between the leading and trailing edges 115 and 118, the third mixing panel 112 defines a first side 154 and a second side 158. The first side 154 of the third mixing panel 112 extends from the third portion 115*c* of the leading edge 114 to the second side 158, and the second side 158 extends from the first side 154 to the third portion 118*c* of the trailing edge 118. Both the first and second sides 154 and 158 also extend from the first surface 112*a* to the second surface 112*b* of the third mixing panel 112. Though the first and second sides 154 and 158 are shown as substantially planar surfaces, the first and second sides 154 and 158 can be alternatively configured as desired. For example, the first and second sides 154 and 158 can be beveled, curved, define sharp edges, etc.

The sides of the third mixing panel 112, like the first and second mixing panels 104 and 108, are configured to meet at respective corners. The third portion 115*c* of the leading edge 115 is configured to meet the first side 154 of the third mixing panel 112 at a first corner 162, the second side 158 of the third mixing panel 112 is configured to meet the third portion 118*c* of the trailing edge 118 at a second corner 166, and the first and second sides 154 and 158 of the third mixing panel 112 are configured to meet at a third corner 170. Due to the curvature of the third mixing panel 112, which will be discussed further below, the first corner 162 is positioned forward along the longitudinal direction 2 and to the right along the lateral direction 4 with respect to the second and third corners 166 and 170, and the second corner 166 is positioned rearward along the longitudinal direction 2 with respect to the first and third corners 162 and 170. Additionally, the second corner 166 is positioned above the first and third corners 162 and 170 along the vertical direction 6, while the first and third corners 162 and 170 are not spaced apart along the vertical direction 6, and the third corner 170 is positioned to the left of the first and second corners 162 and 166 along the lateral direction 4.

The first mixing baffle 101*a* functions to divide, rotate, shift, expand, and recombine the flow of fluid through the mixing passage 48, which functions to mix the flow of fluid. The rotational aspect of this functionality derives from the shape of the first, second, and third mixing panels 104, 108, and 112, which can be curved in some respect in each of the longitudinal, lateral, and vertical directions 2, 4, and 6. In particular, when the first mixing baffle 101*a* is disposed within the mixing passage 48, the first mixing panel 104 is curved such that the first side 124 of the first mixing panel 104 contacts the first inner surface 38*a* of the mixing conduit 20 and the second side 128 contacts the second inner surface 38*b* of the mixing conduit 20. The second mixing panel 108 is curved such that first side 140 of the second mixing panel 108 contacts the second inner surface 38*b* of the mixing conduit 20 and the second side 142 of the second mixing panel 108 contacts the third inner surface 38*c* of the mixing conduit 20. The third mixing panel 112 is curved such that the first side 154 of the third mixing panel 112 contacts the third inner surface 38*c* of the mixing conduit 20 and the second side 158 contacts the first inner surface 38*a* of the mixing conduit 20. Though certain sides of the first, second, and third mixing panels 104, 108, and 112 are described as contacting certain surfaces of the mixing conduit 20, the mixing element 100 may be rotated relative to the mixing conduit 20 when inserted into the mixing passage 48, as desired.

The fluid flowing through the first mixing baffle 101*a* is directed by these various surfaces as follows. The fluid flow enters the mixing passage 48 and generally travels along the flow direction F, which is parallel to the longitudinal direction 2. Upon reaching the first mixing baffle 101*a*, fluid flowing through the mixing passage 48 flows over the leading edge 115 of the first mixing baffle 101*a*. This divides the fluid flow into a first portion, a second portion, and a third portion. The first portion flows between the first mixing panel 104 and the second mixing panel 108, and specifically flows along the first surface 104*a* of the first mixing panel 104 and along the first surface 108*a* of the second mixing panel 108. The second portion flows between the first mixing panel 104 and the third mixing panel 112, and specifically flows along the second surface 104*b* of the first mixing panel 104 and along the second surface 112*b* of the third mixing panel 112. The third portion of the fluid flow flows between the second mixing panel 108 and the third mixing panel 112, and specifically flows along the second surface 108*b* of the second mixing panel 108 and along the first surface 112*a* of the third mixing panel 112. As the first, second, and third portions of the fluid flow travel along the flow direction F, they are rotated by the mixing panels in a first rotational direction. In operation, the first rotational direction can be either the clockwise or counterclockwise direction. From the leading edge 115 to the trailing edge 118, the each portion of the fluid flow can be rotated. The degree of rotation can be increased or decreased as desired. Shifting of the fluid flow occurs in the triangular corners of the mixing conduit 20 along the lateral and/or vertical directions 4, 6 as the material rotates. Additionally, the fluid expands along the inner surfaces 38*a*-38*c* of the mixing conduit 20 as the fluid flows along the flow direction F. This expansion can include stretching, though other methods of expansion are contemplated. As the first, second, and third portions of the fluid flow reach the trailing edge 118, they are recombined into a first mixture that is somewhat mixed relative to the first, unmixed fluid flow comprising two or more fluids that enters the mixing passage 48. However, upon reaching the trailing edge 118, this first mixture may have already begun to be separated by the second mixing baffle 101*b*, which will be described below.

Now referring to FIGS. 8A-8D, the second mixing baffle 101*b* will be described. The features of the second mixing baffle 101*b* can be similar to those of the first mixing baffle 101*a*, as the second mixing baffle 101*b* can be a mirror image of the first mixing baffle 101*a*. However, the second mixing baffle 101*b* need not be a mirror image of the first mixing baffle 101*a*, and can be alternatively configured as desired. The second mixing baffle 101*b* can also be equally representative of each of the second mixing baffles 101*b* throughout the length of the mixing element 100. The second mixing baffle 101*b* defines a first mixing panel 204, a second mixing panel 208, and a third mixing panel 212, each of which extends from a leading edge 215 of the second mixing baffle 101*b* to the trailing edge 218 of the second mixing baffle 101*b*. Each of the first, second, and third mixing panels 204, 208, and 212 can be curved along the longitudinal direction and may substantially form rectangular prisms if flattened into a uniform plane. However, this is not intended to be limiting, and the first, second, and third mixing panels 204, 208, and 212 can form alternative shapes as desired. Each of the first, second, and third mixing panels 204, 208, and 212 can define a portion of the leading edge 215. For example, the first mixing panel 204 can define a first portion 215*a* of the leading edge 215, the second mixing panel 208 can define a second portion 215*b* of the leading edge 215, and the third mixing panel 212 can define a third portion 215*c* of the leading edge 215. Additionally, each of the first, second, and third mixing panels 204, 208, and 212 can define a portion of the trailing edge 218. For example, the first mixing panel 204 can define a first portion 218*a* of the trailing edge 218, the second mixing panel 208 can define a second portion 218*b* of the trailing edge 218, and the third mixing panel 212 can define a third portion 218*c* of the trailing edge 218. Though the leading and trailing edges 215 and 218 are depicted as substantially planar surfaces, the leading and trailing edges 215 and 218 can also be alternatively configured as desired. For example, the leading and trailing edges 215 and 218 can be beveled, curved, define sharp edges, etc.

Each of the mixing panels 204, 208, and 212 are integrally connected to each other. The first mixing panel 204 and the second mixing panel 208 connect at a first junction 221*a*, the first mixing panel 204 and the third mixing panel 212 connect at a second junction 221*b*, and the second mixing panel 208 and the third mixing panel 212 connect at a third junction 221*c*. While each of the first, second, and third junctions 221*a*, 221*b*, and 221*c* are depicted as sharp angles between the mixing panels 204, 208, and 212, the junctions 221*a-c* may be substantially curved, such that the transition from one of the mixing panels 204, 208, and 212 to another of the mixing panels 204, 208, and 212 is gradual.

The first mixing panel 204 of the second mixing baffle 101*b* defines a first surface 204*a* and a second surface 204*b* opposite the first surface 204*a*. The first and second surfaces 204*a* and 204*b* are dimensionally the largest of the first mixing panel 204, and define the regions of the first mixing panel 204 that contact the flow of fluid to rotate the flow of fluid as it flows through the mixing passage 48. The first mixing panel 204 also defines multiple side surfaces that extend between the first and second surfaces 204*a* and 204*b*. The first portion 215*a* of the leading edge 215 extends from the first surface 204*a* to the second surface 204*b* at a forward-most part of the first mixing panel 204, and the first portion 218*a* of the trailing edge 218 extends from the first surface 204*a* to the second surface 204*b* at a rearward-most part of the first mixing panel 204. Between the leading and trailing edges 215 and 218, the first mixing panel 204 defines a first side 224 and a second side 228. The first side 224 of the first mixing panel 204 extends from the first portion 215*a* of the leading edge 215 to the second side 228, and the second side 228 extends from the first side 224 to the first portion 218*a* of the trailing edge 218. Both the first and second sides 224 and 228 also extend from the first surface 204*a* to the second surface 204*b*. Though the first and second sides 224 and 228 are shown as substantially planar surfaces, the first and second sides 224 and 228 can be alternatively configured as desired. For example, the first and second sides 224 and 228 can be beveled, curved, define sharp edges, etc.

The sides of the first mixing panel 204 are configured to meet at respective corners. The first portion 215*a* of the leading edge 215 is configured to meet the first side 224 of the first mixing panel 204 at a first corner 232, the second side 228 of the first mixing panel 204 is configured to meet the first portion 218*a* of the trailing edge 218 at a second corner 234, and the first and second sides 224 and 228 of the first mixing panel 204 are configured to meet at a third corner 238. Due to the curvature of the first mixing panel 204, which will be discussed further below, the first corner 232 is positioned forward along the longitudinal direction 2 with respect to the second and third corners 234 and 238, the second corner 238 is positioned rearward along the longitudinal direction 2 with respect to the first and third corners 232 and 238, and the third corner 238 is positioned to the left of the first and second corners 232 and 234 along the lateral direction 4. Additionally, the first corner 232 is positioned above the second and third corners 234 and 238 along the vertical direction 6, while the second and third corners 234 and 238 are not offset from each other along the vertical direction 6. Further, the first and second corners 232 and 234 are not spaced apart along the lateral direction 4.

The second mixing panel 208 of the second mixing baffle 101*b* can be similarly configured to the first mixing panel 204. The second mixing panel 208 also defines a first surface 208*a* and a second surface 208*b* opposite the first surface 208*a*. The first and second surfaces 208*a* and 208*b* of the second mixing panel are dimensionally the largest, and define regions of the second mixing panel 208 that contact the flow of fluid to rotate the flow of fluid as it flows through the mixing passage 48. The second mixing panel 208 further defines multiple side surfaces that extend between the first and second surfaces 208*a* and 208*b*. Like the first mixing panel 204, the second portion 215*b* of the leading edge 215 extends from the first surface 208*a* of the second mixing panel 208 to the second surface 208*b* at a forward-most part of the second mixing panel 208, and the second portion 215*b* of the trailing edge 218 extends from the first surface 208*a* to the second surface 208*b* at a rearward-most part of the second mixing panel 208. Between the leading and trailing edges 215 and 218, the second mixing panel 208 defines a first side 240 and a second side 242.

The second mixing panel 208 can be similarly configured as the first mixing panel 204. The second mixing panel 208 also defines a first surface 208*a* and a second surface 208*b* opposite the first surface 208*a*. The first and second surfaces 208*a* and 208*b* of the second mixing panel 208 are dimensionally the largest, and define regions of the second mixing panel 208 that contact the flow of fluid to direct it through the mixing passage 48. The second mixing panel 208 further defines multiple side surfaces that extend between the first and second surfaces 208*a* and 208*b*. Like the first mixing panel 208, the second portion 215*b* of the leading edge 215 extends from the first surface 208*a* of the second mixing panel 208 to the second surface 208*b* at a forward-most part of the second mixing panel 208, and the second portion 215*b* of the trailing edge 218 extends from the first surface 208*a* to the second surface 208*b* at a rearward-most part of the second mixing panel 208. Between the leading and trailing edges 215 and 218, the second mixing panel 208 defines a first side 240 and a second side 242. The first side 240 of the second mixing panel 208 extends from the second portion 215*b* of the leading edge 215 to the second side 242, and the second side 242 extends from the first side 240 to the second portion 218*b* of the trailing edge 218. Both the first and second sides 240 and 242 also extend from the first surface 208*a* to the second surface 208*b*. Though the first and second sides 240 and 242 are shown as substantially planar surfaces, the first and second sides 240 and 242 can be alternatively configured as desired. For example, the first and second sides 240 and 242 can be beveled, curved, define sharp edges, etc.

The sides of the second mixing panel 208 are configured to meet at respective corners. The second portion 215*b* of the leading edge 215 is configured to meet the first side 240 of the second mixing panel 208 at a first corner 246, the second side 242 of the second mixing panel 208 is configured to meet the second portion 218*b* of the trailing edge 218 at a second corner 248, and the first and second sides 240 and 242 of the second mixing panel 208 are configured to meet at a third corner 250. Due to the curvature of the second mixing panel 208, which will be discussed further below, the first corner 246 is positioned forward along the longitudinal direction 2 and to the right along the lateral direction 4 with respect to the second and third corners 248 and 250, and the second corner 248 is positioned rearward along the longitudinal direction 2 and to the left along the lateral direction 4 with respect to the first and third corners 246 and 250. Additionally, the first corner 246 is positioned below the second and third corners 248 and 250 along the vertical direction 6, while the second corner 248 is positioned below the third corner 250 but above the first corner 246 along the vertical direction 6.

The third mixing panel 212 can be similarly configured as the first and second mixing panels 204 and 208 of the second mixing baffle 101*b*. The third mixing panel 212 also defines a first surface 212*a* and a second surface 212*b* opposite the first surface 212*a*. The first and second surfaces 212*a* and 212*b* of the third mixing panel 212 are dimensionally the largest of the surfaces of the third mixing panel 212, and define the regions of the third mixing panel 212 that contact the flow of fluid to rotate the flow of fluid as it flows through the mixing passage 48. The third mixing panel 212 further defines multiple side surfaces that extend between the first and second surfaces 212*a* and 212*b*. Like the first and second mixing panels 204 and 208, the third portion 215*c* of the leading edge 215 extends from the first surface 212*a* to the second surface 212*b* of the third mixing panel 212 at a forward-most part of the third mixing panel 212, and the third portion 218*c* of the trailing edge 218 extends from the first surface 212*a* to the second surface 212*b* at a rearward-most part of the third mixing panel 212. Between the leading and trailing edges 215 and 218, the third mixing panel 212 defines a first side 254 and a second side 258. The first side 254 of the third mixing panel 212 extends from the third portion 215*c* of the leading edge 215 to the second side 258, and the second side 258 extends from the first side 254 to the third portion 218*c* of the trailing edge 218. Both the first and second sides 254 and 258 also extend from the first surface 212*a* to the second surface 212*b* of the third mixing panel 212. Though the first and second sides 254 and 258 are shown as substantially planar surfaces, the first and second sides 254 and 258 can be alternatively configured as desired. For example, the first and second sides 254 and 258 can be beveled, curved, define sharp edges, etc.

The sides of the third mixing panel 212, like the first and second mixing panels 204 and 208, are configured to meet at respective corners. The third portion 215*c* of the leading edge 215 is configured to meet the first side 254 of the third mixing panel 212 at a first corner 262, the second side 258 of the third mixing panel 212 is configured to meet the third portion 218*c* of the trailing edge 218 at a second corner 266, and the first and second sides 254 and 258 of the third mixing panel 212 are configured to meet at a third corner 270. Due to the curvature of the third mixing panel 212, which will be discussed further below, the first corner 252 is positioned forward along the longitudinal direction 2 and to the left along the lateral direction 4 with respect to the second and third corners 266 and 270, and the second corner 266 is positioned rearward along the longitudinal direction 2 with respect to the first and third corners 262 and 270. Additionally, the second corner 266 is positioned above the first and third corners 262 and 270 along the vertical direction 6, while the first and third corners 262 and 270 are not spaced apart along the vertical direction 6. Also, the third corner 270 is positioned to the right of the first and second corners 262 and 266 along the lateral direction 4.

Like the first mixing baffle 101*a*, the second mixing baffle 101*b* functions to divide, and rotate, shift, or expand and recombine the flow of fluid through the mixing passage 48, which functions to mix the flow of fluid. The rotational aspect of this functionality derives from the shape of the first, second, and third mixing panels 204, 208, and 212, which can be curved in some respect in each of the longitudinal, lateral, and vertical direction 2, 4, and 6. In particular, when the second mixing baffle 101*b* is disposed within the mixing passage 48, the first mixing panel 204 is curved such that the first side 224 of the first mixing panel 204 contacts the first inner surface 38*a* of the mixing conduit 20 and the second side 228 contacts the third inner surface 38*c* of the mixing conduit 20. The second mixing panel 208 is curved such that the first side 240 of the second mixing panel 208 contacts the second inner surface 38*b* of the mixing conduit 20 and the second side 242 of the second mixing panel 208 contacts the first inner surface 38*a* of the mixing conduit. The third mixing panel 212 is curved such that the first side 254 of the third mixing panel 212 contacts the third inner surface 38*c* of the mixing conduit 20 and the second side 258 contacts the second inner surface 38*b* of the mixing conduit 20. Though certain sides of the first, second, and third mixing panels 204, 208, and 212 are described as contacting certain surfaces of the mixing conduit 20, the mixing element 300 may be rotated relative to the mixing conduit 20 when inserted into the mixing passage 48, as desired.

The fluid flowing through the second mixing baffle 101*b* is directed by the second mixing baffle 101*b* to generally rotate in a second rotational direction that is opposite the first rotational direction as it flows in the longitudinal direction 2, whereas the first mixing baffle 101*a* generally rotates the fluid flow in the first rotational direction, as described above. Upon reaching the second mixing baffle 101*b*, the first mixture, which is formed from the fluid flow by the first mixing baffle, flows through the mixing passage 48 and over the leading edge 215 of the first mixing baffle 101*a*. This divides the first mixture into a first portion, a second portion, and a third portion. The first portion flows between the first mixing panel 204 and the second mixing panel 208, and specifically flows along the first surface 204*a* of the first mixing panel 204 and along the first surface 208*a* of the second mixing panel 208. The second portion flows between the first mixing panel 204 and the third mixing panel 212, and specifically flows along the second surface 204*b* of the first mixing panel 204 and along the first surface 212*a* of the third mixing panel 212. The third portion of the fluid flow flows between the second mixing panel 208 and the third mixing panel 212, and specifically flows along the second surface 208*b* of the second mixing panel 208 and along the second surface 212*b* of the third mixing panel 212. As the first, second, and third portions of the fluid flow travel along the flow direction F, they are rotated by the mixing panels in the second rotational direction. From the leading edge 215 to the trailing edge 218, each portion of the fluid flow can be rotated. The degree of rotation can be increased or decreased as desired. Shifting of the fluid flow occurs in the lateral and/or vertical directions 4, 6 in the triangular corners of the mixing conduit 20 as the material rotates. Additionally, the fluid expands along the inner surfaces 38*a*-38*c* of the mixing conduit 20 as the fluid flows along the flow direction F. This expansion can include stretching, though other methods of expansion are contemplated. As the first, second, and third portions of the fluid flow reach the trailing edge 218, they are recombined into a second mixture that is further mixed relative to the first mixture that first comes into contact with the second mixing baffle 101*b*. However, upon reaching the trailing edge 218 of the second mixing baffle 101*b*, the second mixture may have already begun to be separated by a second first mixing baffle 101*a*. The fluid flowing through the mixing passage may be continuously divided, mixed, and recombined by additional first and second mixing baffles 101*a* and 101*b*, until a substantially homogenous mixture is produced at the trailing end of the mixing element 100.

Figure 9:
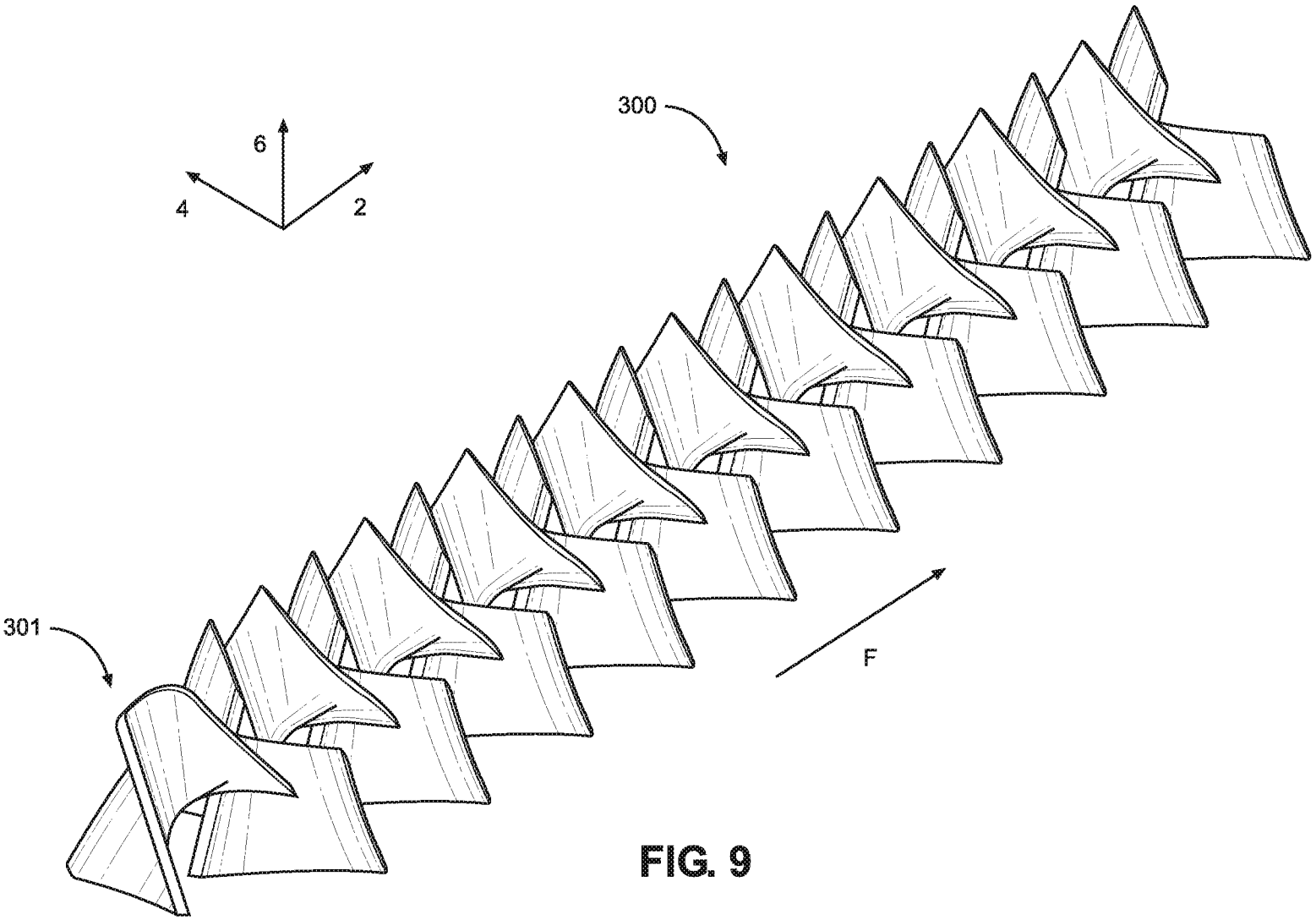
FIG. 9 is a perspective view of a mixing element according to another embodiment of the application.

Continuing with FIGS. 9-10B, an alternative embodiment of a mixing element 300 will be described. Like the mixing element 100, the mixing element 300 is configured to be inserted into the mixing passage 48 of the mixing conduit 20. The mixing element 300 is also comprised of a plurality of mixing baffles 301. The mixing element 300 can be constructed using an alternating arrangement of first mixing baffles 301*a* and second mixing baffles 301*b*. In the depicted embodiment, the second mixing baffles 301*b* are mirror images of the first mixing baffles 301*a*. However, the mixing element 300 can be alternatively configured, such that a certain number of the first mixing baffles 301*a* and the second mixing baffles 301*b* repeat after each other. The mixing element 300 can be formed as a single unitary structure that defines each of the first and second mixing baffles 301*a* and 301*b*. For example, the mixing element 300 can be formed through molding.

Figure 10A:
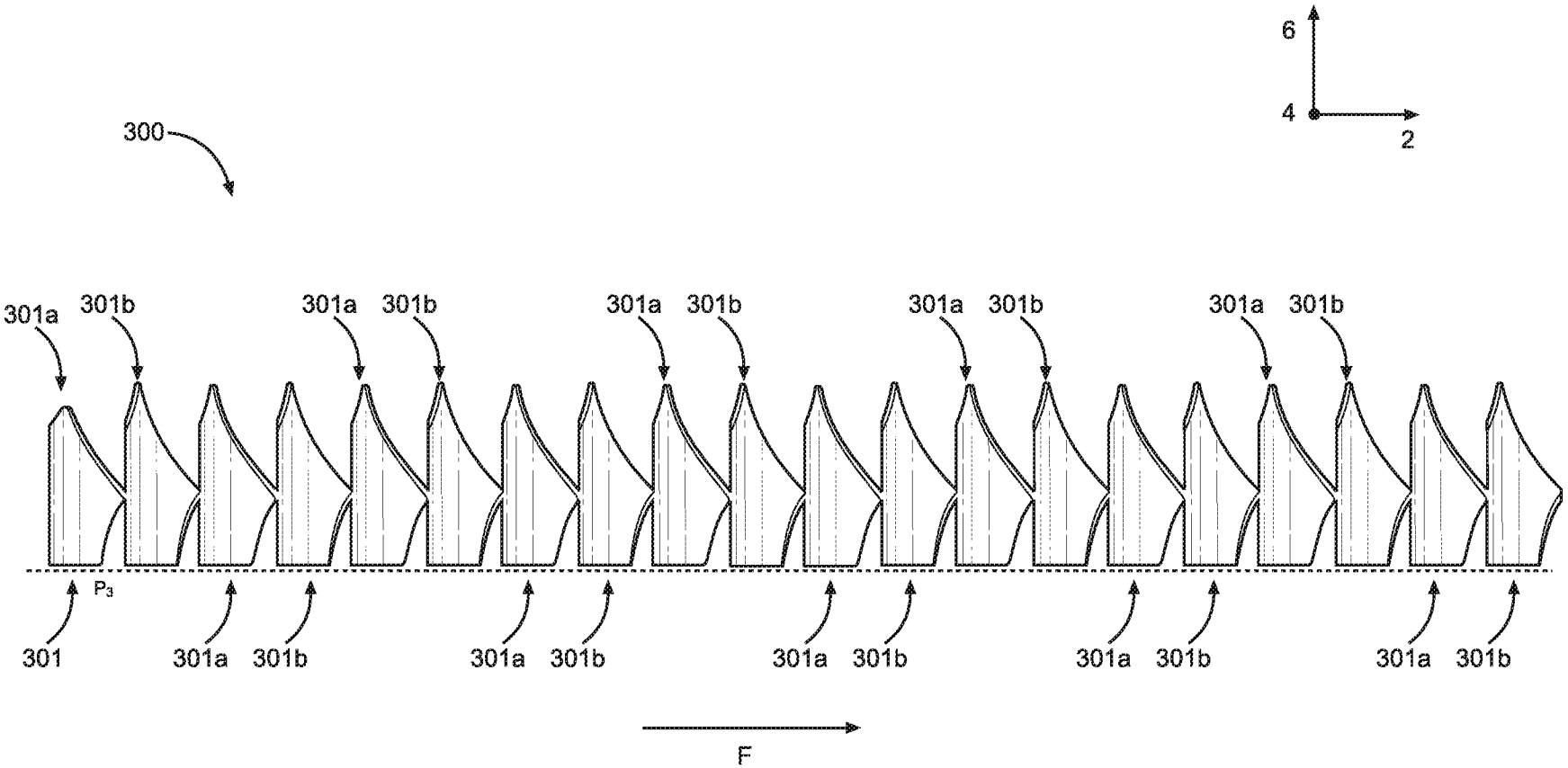
FIG. 10A is a side view of the mixing element shown in FIG. 11.

The mixing element 300, like the mixing element 100, is configured such that two or more fluids are mixed as they flow through the mixing passage 48 of the mixing conduit 20 along the mixing element 300. As shown in FIGS. 9 and 10A, the fluid flow extends along the flow direction F as the fluid flows from the first mixing baffle 301 in the mixing element 300, which may be a first or second mixing baffle 301*a* or 301*b*, to the last mixing baffle 301 in the mixing element 300, which may also be a first or second mixing baffle 301*a* or 301*b*. Each of the mixing baffles 301, like the mixing baffles 101, divides the fluid flow through the mixing passage 48 at a leading edge of the mixing baffles 301, and then rotates, shifts, and expands the fluid flow before recombining the fluid flow at a trailing edge of the mixing baffles 301. However, unlike the mixing baffles 101, the mixing baffles 301 divide the fluid flow into two portions through each of the mixing baffles 301 before recombining the fluid flow. As the fluid flow is being recombined at a trailing edge of a mixing baffle 301, the fluid flow may already have begun being separated by the leading edge of a subsequent mixing baffle 301, as the trailing edge of one mixing baffle may overlap along the longitudinal direction 2 with the leading edge of a subsequent mixing baffle 301.

Figure 10B:
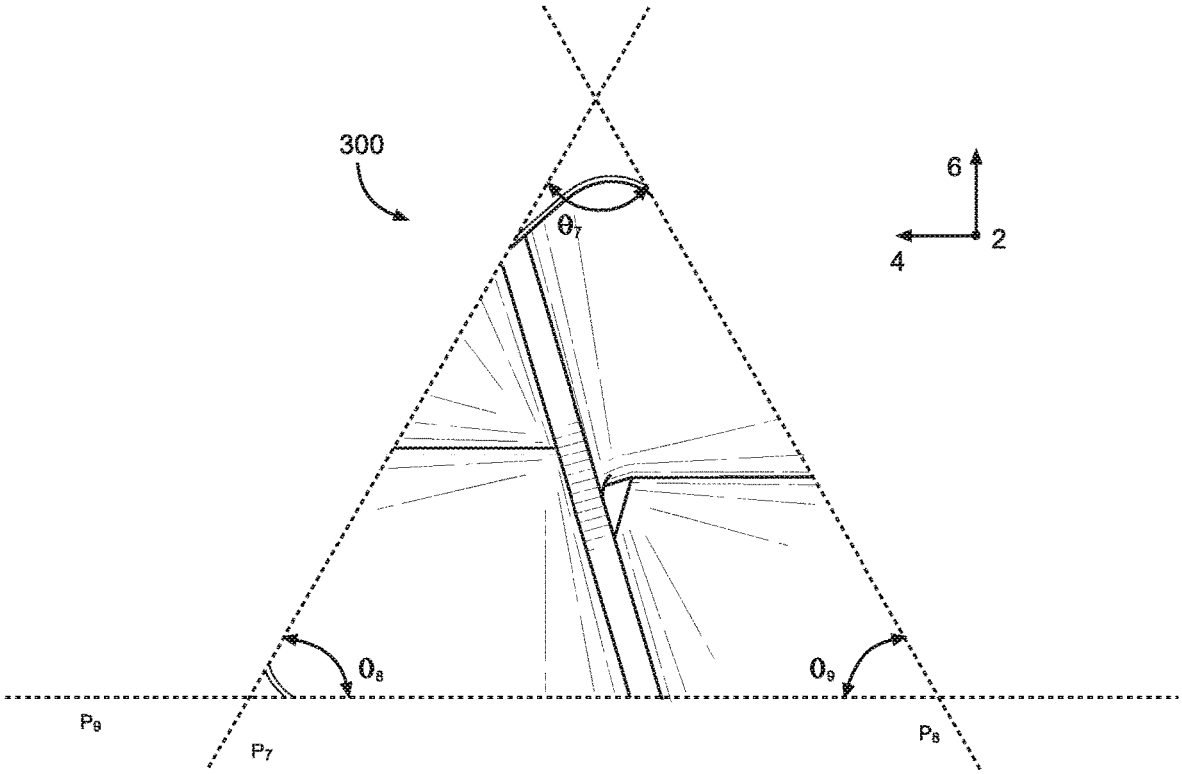
FIG. 10B is a front view of the mixing element shown in FIG. 11.
Figure 11A:
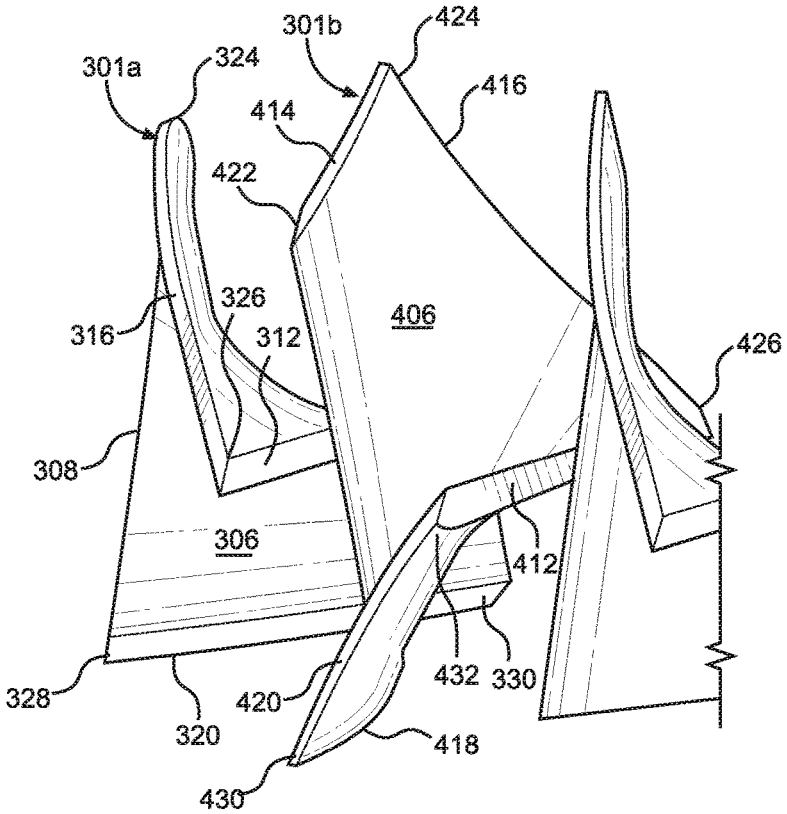
FIG. 11A is a right rear view of the first and second mixing baffles shown in FIG. 10A.
Figure 11B:
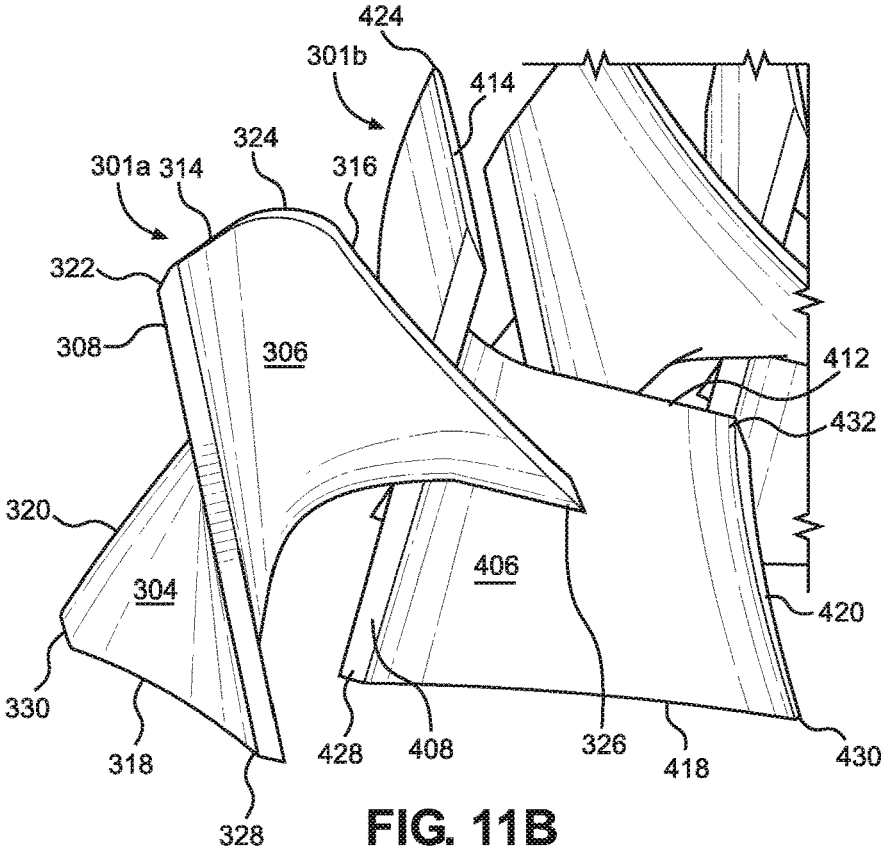
FIG. 11B is a right front view of the first and second mixing baffles shown in FIG. 10A.
Figure 11C:
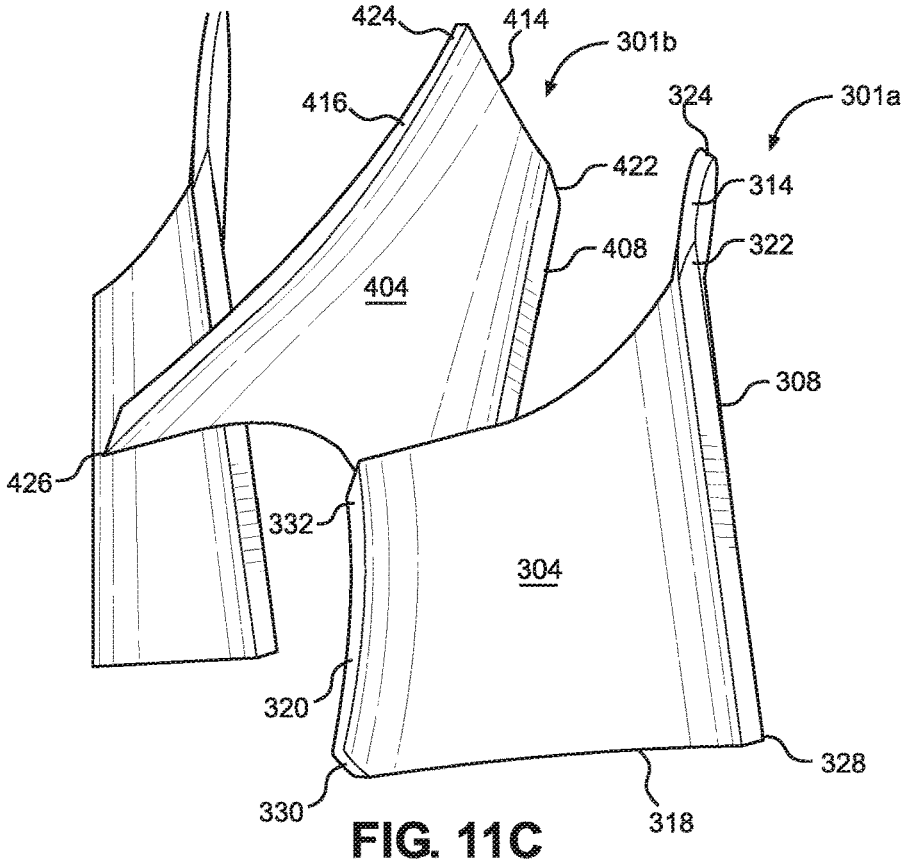
FIG. 11C is a left front view of the first and second mixing baffles shown in FIG. 10A.
Figure 11D:
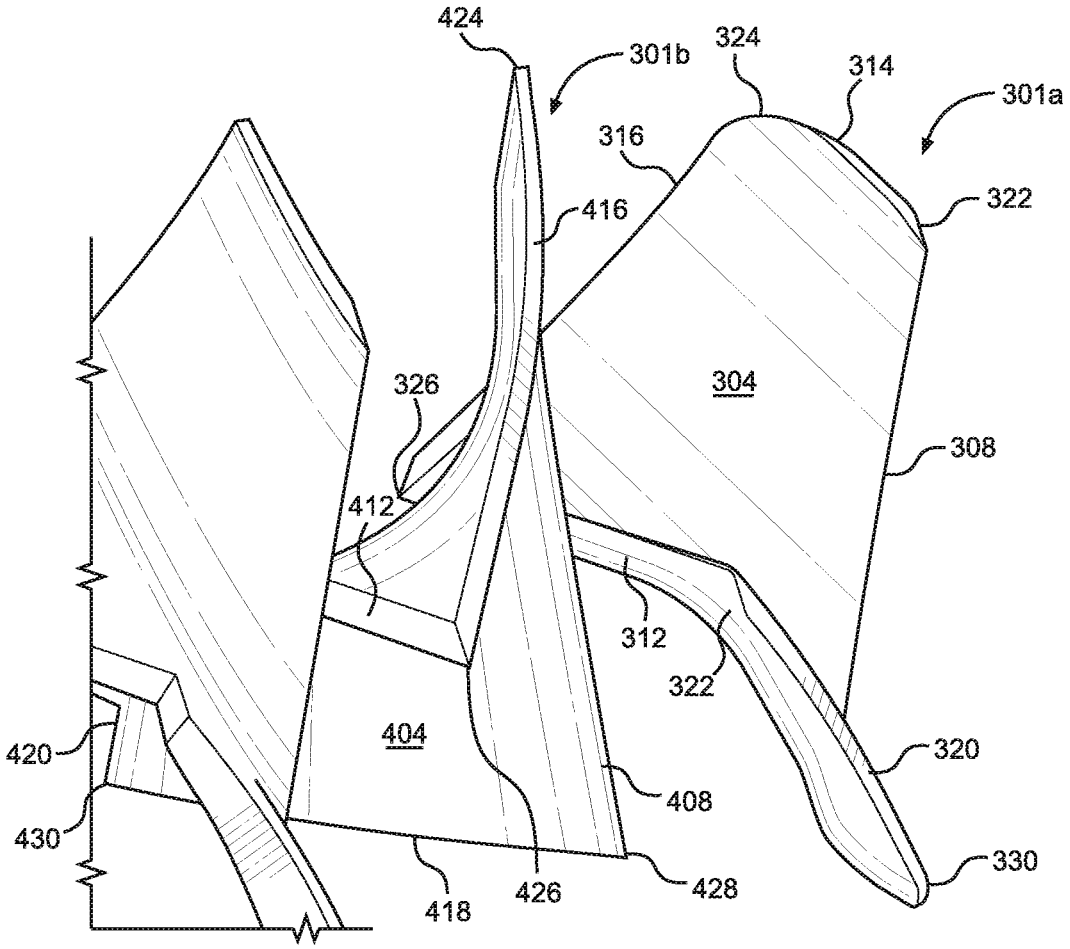
FIG. 11D is a left rear view of the first and second mixing baffles shown in FIG. 10A.

Like the mixing passage 48 of the mixing conduit 20, the mixing element 300 can define a triangular cross section when viewed from a plane that extends in the lateral and vertical direction 4 and 6, as shown in FIG. 10B. The profile of the mixing element 300 when viewed from this plane can be defined by a first plane $P_7$, a second plane $P_8$, and a third plane $P_9$. The first plane $P_7$ of the mixing element 300 can be offset from the second plane $P_8$ by a first angle $\theta_7$, the first plane $P_7$ can be offset from the third plane $P_9$ by a second angle $\theta_8$, and the second plane $P_8$ can be offset from the third plane $P_9$ by a third angle $\theta_9$. Each of the first, second, and third angles $\theta_7$, $\theta_8$, and $\theta_9$ can be equal (as shown in FIG. 10B), in which case each of the first, second, and third angles $\theta_7$, $\theta_8$, and $\theta_9$ is 60 degrees. Alternatively, the first, second, and third angles $\theta_7$, $\theta_8$, and $\theta_9$ can be altered as desired, so that the cross section of the mixing element 300 can define an acute, isosceles, or obtuse triangle. Regardless of the type of triangle formed by the cross section of the mixing element 300, the mixing element 300 will generally conform in cross-sectional shape to the cross-sectional shape of the mixing passage 48 of the mixing conduit 20. As a result, when the mixing element 300 is disposed within the mixing passage 48, the first plane $P_1$ of the mixing conduit 20 can be parallel to the first plane $P_7$ of the mixing element 300, the second plane $P_2$ of the mixing conduit 20 can be parallel to the second plane $P_8$ of the mixing element 300, and the third plane $P_3$ of the mixing conduit 20 can be parallel to the third plane $P_9$ of the mixing element 300. However, the mixing element 300 can be rotated relative to the mixing conduit 20 such that the mixing element 300 may be inserted into the mixing passage 48 in other orientations, in which case different ones of the first through third planes $P_1$-$P_3$ of the mixing conduit 20 will be parallel to different ones of the first through third planes $P_7$-$P_9$ of the mixing element 300.

Now referring to FIGS. 11A-D, the first mixing baffle 301*a* of the mixing element 300 will be described. The features of the first mixing baffle 301*a* as described below can be equally representative of each of the first mixing baffles 301*a* present throughout the length of the mixing element 300. However, as shown in FIGS. 11A-11D, features of each of the first mixing baffles 301*a* can differ. The first mixing baffle 301*a* defines a first surface 304 and a second surface 306 opposite the first surface 304. The first and second surfaces 304 and 306 are dimensionally the largest of the first mixing baffle 301*a*, and define the regions of the first mixing baffle 301*a* that contact the flow of fluid to rotate the flow of fluid as it flows through the mixing passage 48. The first and second surfaces 304 and 306 also extend from a leading edge 308 to a trailing edge 312 of the first mixing baffle 301*a*. The leading edge 308 of the first mixing baffle 301*a* defines the forward-most part of the first mixing baffle 301*a* along the longitudinal direction 2, and the trailing edge 312 defines the rearward-most part of the first mixing baffle 301*a* along the longitudinal direction 2.

The first mixing baffle 301*a* also defines multiple side surfaces that extend between the first and second surfaces 304 and 306, as well as between the leading and trailing edges 308 and 312. The first mixing baffle 301*a* defines a first side 314 and a second side 316, where the first side 314 extends from the leading edge 308 to the second side 316, and the second side 316 extends from the first side 314 to the trailing edge 312. Both the first and second sides 314 and 316 also extend from the first surface 304 to the second surface 306. The first mixing baffle 301*a* further defines a third side 318 and a fourth side 320, where the third side 318 extends from the leading edge 308 to the fourth side 320, and the fourth side 320 extends from the third side 318 to the trailing edge 312. Both the third and fourth sides 318 and 320 extend from the first surface 304 to the second surface 306. Though the first, second, third, and fourth sides 314, 316, 318, and 320 are shown as substantially planar surfaces, the first, second, third, and fourth sides 314, 316, 318, and 320 can be alternatively configured as desired. For example, the first, second, third, and fourth sides 314, 316, 318, and 320 can be beveled, curved, define sharp edges, etc.

The sides of the first mixing baffle 301*a* are configured to meet at respective corners. The leading edge 308 of the first mixing baffle 301*a* is configured to meet the first side 314 at a first corner 322, the second side 324 is configured to meet the first side 314 at a second corner 324, and the second side 324 is configured to meet the trailing edge 312 at a third corner 326. Due to the curvature of the first mixing baffle 301*a*, which will be discussed further below, the first corner 322 is positioned forward along the longitudinal direction 2 and to the left along the lateral direction 4 with respect to the second and third corners 324 and 326. The third corner 326 is positioned rearward along the longitudinal direction 2 and to the right along the lateral direction 4 with respect to the first and second corners 322 and 324. Additionally, the second corner 324 is positioned above the first and third corners 322 and 326 along the vertical direction 6, while the third corner 326 is positioned below the first and second corners 322 and 324 along the vertical direction 6.

The leading edge 308 of the first mixing baffle 301*a* is also configured to meet a third side 318 at a fourth corner 328. The third side 318 is configured to meet a fourth side 320 at a fifth corner 330, and the fourth side 320 is configured to meet the trailing edge 312 at a sixth corner 332. Due to the curvature of the first mixing baffle 301*a*, the fourth corner 328 is positioned forward along the longitudinal direction 2 and to the right along the lateral direction 4 with respect to the fifth and sixth corners 330 and 332, while the sixth corner 332 is positioned rearward along the longitudinal direction 2 with respect to the fourth and fifth corners 328 and 332. The fifth corner 330 is positioned to left of the fourth and sixth corners 328 and 332 along the lateral direction 4. Additionally, the sixth corner 332 is positioned above the fourth and fifth corners 328 and 330 along the vertical direction 6, while the fourth and fifth corners 328 and 330 are not spaced apart along the vertical direction 6. As shown in FIGS. 11A-11D, some of the first through sixth corners 322, 324, 326, 328, 330, and 332 are beveled, some are curved, and some define sharp angles. Though a particular embodiment is shown, any of the corners of the first mixing baffle 301*a* can be curved, beveled, or define sharp angles as desired. For example, other first mixing baffles 301*a* of the mixing element 300 have differently configured corners, as shown in FIGS. 9 and 10A.

FIGS. 11A-11D also depict the second mixing baffle 301*b*. The second mixing baffle 301*b* can be similarly configured as the first mixing baffle 301*a*. For example, the second mixing baffle 301*b* can be a mirror image of the first mixing baffle 301*a*. The second mixing baffle 301*b* as described below can be equally representative of each of the second mixing baffles 301*b* present throughout the length of the mixing element 300. The second mixing baffle 301*b* defines a first surface 404 and a second surface 406 opposite the first surface 404. The first and second surfaces 404 and 406 are dimensionally the largest of the second mixing baffle 301*b*, and define the regions of the second mixing baffle 301*b* that cause the flow of fluid to rotate as it flows through the mixing passage 48. The first and second surfaces 404 and 406 also extend from a leading edge 408 to a trailing edge 412 of the second mixing baffle 301*b*. The leading edge 408 of the second mixing baffle 301*b* defines the forward-most part of the second mixing baffle 301*b*, and the trailing edge 412 defines the rearward-most part of the second mixing baffle 301*b* along the longitudinal direction 2. The lead edge 408 of the second mixing baffle 301*b* also defines the portion of the second mixing baffle 301*b* that connects the second mixing baffle 301*b* to the first mixing baffle 301*a*. As shown in FIGS. 11A-11D, the leading edge 408 of the second mixing baffle 301*b* is integrally connected to the trailing edge 312 of the first mixing baffle 301*a*, such that the first and second mixing baffles 301*a* and 301*b* form a monolithic structure.

The second mixing baffle 301*b* also defines multiple side surfaces that extend between the first and second surfaces 404 and 406, as well as between the leading and trailing edges 408 and 412. The first mixing baffle 401*a* defines a first side 414 and a second side 416, where the first side 414 extends from the leading edge 408 to the second side 416, and the second side 416 extends from the first side 414 to the trailing edge 412. Both the first and second sides 414 and 416 also extend from the first surface 404 to the second surface 406. The second mixing baffle 301*b* further defines a third side 418 and a fourth side 420, where the third side 418 extends from the leading edge 408 to the fourth side 420, and the fourth side 420 extends from the third side 418 to the trailing edge 412. Both the third and fourth sides 418 and 420 extend from the first surface 404 to the second surface 406. Though the first, second, third, and fourth sides 414, 416, 418, and 420 are shown as substantially planar surfaces, the first, second, third, and fourth sides 414, 416, 418, and 420 can be alternatively configured as desired. For example, the first, second, third, and fourth sides 414, 416, 418, and 420 can be beveled, curved, define sharp edges, etc.

The sides of the second mixing baffle 301*b* are configured to meet at respective corners. The leading edge 408 of the second mixing baffle 301*b* is configured to meet the first side 414 at a first corner 422, the second side 416 is configured to meet the first side 414 at a second corner 424, and the second side 416 is configured to meet the trailing edge 412 at a third corner 426. Due to the curvature of the second mixing baffle 301*b*, which will be discussed further below, the first corner 422 is positioned forward along the longitudinal direction 2 and to the right along the lateral direction 4 with respect to the second and third corners 424 and 426. The third corner 426 is positioned rearwards along the longitudinal direction 2 and to the left along the lateral direction 4 with respect to the first and second corners 422 and 424. Additionally, the second corner 424 is positioned above the first and third corners 422 and 426 along the vertical direction 6, while the third corner 426 is positioned below the first and second corners 422 and 424 along the vertical direction 6.

The leading edge 408 of the second mixing baffle 301*b* is also configured to meet the third side 418 at the fourth corner 428. The third side 418 is configured to meet the fourth side 420 at a fifth corner 430, and the fourth side 420 is configured to meet the trailing edge 412 at a sixth corner 432. Due to the curvature of the second mixing baffle 301*b*, the fourth corner 428 is positioned forward along the longitudinal direction 2 and to the left along the lateral direction 4 with respect to the fifth and sixth corners 430 and 432, while the sixth corner 432 is positioned rearward along the longitudinal direction 2 with respect to the fourth and fifth corners 428 and 432. The fifth corner 430 is positioned to the right of the fourth and sixth corners 428 and 432 along the lateral direction 4. Additionally, the sixth corner 432 is positioned above the fourth and fifth corners 428 and 430 along the vertical direction 6, while the fourth and fifth corners 428 and 430 are not spaced apart along the vertical direction 6. As shown in FIGS. 11A-11D, the first through sixth corners 422, 424, 426, 428, 430, and 432 define sharp angles. Though a particular embodiment is shown, any of the corners of the second mixing baffle 301*b* can be curved, beveled, or define sharp angles as desired. Additionally, other second mixing baffles 301*b* along the mixing element 300 can have differently configured corners as desired.

The first and second mixing baffles 301*a* and 301*b* of the mixing element 300 function to divide, rotate, shift, expand, and recombine the flow of fluid through the mixing passage 48, which functions to mix the flow of fluid. The rotational aspect of this functionality derives from the shape of the first and second mixing baffles 301*a* and 301*b*, which are curved in some respect in each of the longitudinal, lateral, and vertical directions 2, 4, and 6. In particular, when the mixing element 300 is disposed in the mixing passage 48, the first mixing baffle 301*a* is curved such that the first side 314 of the first mixing baffle 301*a* contacts the first inner surface 38*a* of the mixing conduit 20, the second side 316 contacts the second inner surface 38*b* of the mixing conduit 20, the third side 318 contacts the third inner surface 38*c* of the mixing conduit 20, and the fourth side 320 contacts the first inner surface 38*a* of the mixing conduit 20. Shifting of the fluid flow occurs in the lateral and/or vertical directions 4, 6 in the triangular corners of the mixing conduit 20 as the material rotates. Additionally, the fluid expands along the inner surfaces 38*a*-38*c* of the mixing conduit 20 as the fluid flows along the flow direction F. This expansion can include stretching, though other methods of expansion are contemplated. The second mixing baffle 301*b* is curved such that the first side 414 of the second mixing baffle 301*b* contacts the second inner surface 38*b* of the mixing conduit 20 when the mixing element 300 is disposed in the mixing passage 48, the second side 416 contacts the first inner surface 38*a*, the third side 418 contacts the third inner surface 38*c*, and the fourth side 420 contacts the second inner surface 38*b*. Though certain sides of the first and second mixing baffles 301*a* and 301*b* are described as contacting certain surfaces of the mixing conduit 20, the mixing element 300 may be rotated relative to the mixing conduit 20 when inserted into the mixing passage 48, such that different sides of the first and second mixing baffles 301*a* and 301*b* contact different parts of the inner surface 38 of the mixing conduit.

The fluid flowing through the first mixing baffle 301*a* is directed by the first mixing baffle 301*a* to generally rotate in a first rotational direction as it flows in the longitudinal direction 2. In operation, the first rotational direction can be either of the clockwise and counterclockwise directions. Upon reaching the first mixing baffle 301*a*, the fluid flow flows through the mixing passage 48 and over the leading edge 308 of the first mixing baffle 301*a*. This divides the fluid flow into a first portion and a second portion. The first portion flows along the first surface 304 of the first mixing baffle 301*a*, and the second portion flows along the second surface 306 of the first mixing baffle 301*a*. As the first and second portions of the fluid flow flow along the flow direction F, they are rotated by the first mixing baffle 301*a* in the first rotational direction. From the leading edge 308 to the trailing edge 312, each portion of the fluid flow can be rotated. The degree of rotation can be increased or decreased as desired. Shifting of the fluid flow occurs in the lateral and/or vertical directions 4, 6 in the triangular corners of the mixing conduit 20 as the material rotates. Additionally, the fluid expands along the inner surfaces 38*a*-38*c* of the mixing conduit 20 as the fluid flows along the flow direction F. This expansion can include stretching, though other methods of expansion are contemplated. As the first and second portions of the fluid flow reach the trailing edge 312, they are recombined into a first mixture that is further mixed relative to the fluid flow that first comes into contact with the first mixing baffle 301*a*. However, upon reaching the trailing edge 312 of the first mixing baffle 301*a*, the fluid flow may have already begun to be separated by the second mixing baffle 301*b*.

Upon reaching the second mixing baffle 301*b*, the first mixture flows through the mixing passage 48 and over the leading edge 408 of the second mixing baffle 301*b*. This divides the first mixture into a first portion and a second portion. The first portion flows along the first surface 404 of the second mixing baffle 301*b*, and the second portion flows along the second surface 406 of the second mixing baffle 301*b*. As the first and second portions of the first mixture flow along the flow direction F, they are rotated by the second mixing baffle 301*b* in a second rotational direction that is opposite the first rotational direction. From the leading edge 408 to the trailing edge 412, each portion of the first mixture can be rotated. The degree of rotation can be increased or decreased as desired. Shifting of the fluid flow occurs in the lateral and/or vertical directions 4, 6 in the triangular corners of the mixing conduit 20 as the material rotates. Additionally, the fluid expands along the inner surfaces 38*a*-38*c* of the mixing conduit 20 as the fluid flows along the flow direction F. This expansion can include stretching, though other methods of expansion are contemplated. As the first and second portions of the first mixture reach the trailing edge 412 of the second mixing baffle 301*b*, they are recombined into a second mixture that is further mixed relative to the first mixture that comes into contact with the second mixing baffle 301*b*. The fluid then flows through the mixing passage 48 and is continuously divided, mixed, and recombined by additional first and second mixing baffles 301*a*, 301*b*, and 301*c*, until a substantially homogenous mixture is produced at the trailing end of the mixing element 300.

While the invention is described herein using a limited number of embodiments, these specific embodiments are not intended to limit the scope of the invention as otherwise described and claimed herein. The precise arrangement of various elements and order of the steps of articles and methods described herein are not to be considered limiting. For instance, although the steps of the methods are described with reference to sequential series of reference signs and progression of the blocks in the figures, the method can be implemented in a particular order as desired.

What is claimed:

1. A static mixer for mixing a fluid flow having at least two components, the static mixer comprising:

a mixing conduit defining an inner surface that comprises a first inner surface, a second inner surface that extends from the first inner surface, and a third inner surface that extends from the first inner surface to the second inner surface, such that the first, second, and third inner surfaces define a mixing passage configured to receive the fluid flow, and the first and second inner surfaces are offset by a first acute angle, the first and third inner surfaces are offset by a second acute angle, and the second and third inner surfaces are offset by a third acute angle; and a mixing element positioned in the mixing passage and defining a substantially triangular cross-section, wherein the mixing element is configured to contact the first, second, and third inner surfaces and defines a first mixing baffle that extends from a leading edge to a trailing edge, the first mixing baffle configured to divide the fluid flow into a first portion and a second portion and the leading edge defined by a plurality of leading edge portions obliquely angled relative to each of the first, second, and third inner surfaces of the mixing conduit.

2. The static mixer of claim 1, wherein the mixing conduit defines an outer surface comprising a first outer surface that is substantially parallel to the first inner surface, a second outer surface that is substantially parallel to the second inner surface, and a third outer surface that is substantially parallel to the third inner surface.

3. The static mixer of claim 1, wherein the mixing conduit further comprises:

a body section that defines the mixing passage;

a socket connected to the body section, wherein the socket defines a socket opening in communication with the mixing passage; and a nozzle connected to the body section opposite the socket, wherein the nozzle defines an outlet in communication with the mixing passage, wherein the fluid flow is configured to flow through the socket opening, through the mixing passage, and out the outlet.

4. The static mixer of claim 3, wherein the socket defines an inner surface that is at least partially threaded.

5. The static mixer of claim 1, wherein the first mixing baffle includes a first mixing panel, a second mixing panel, and a third mixing panel, each of the first, second, and third mixing panels partially defining the leading edge and the trailing edge, wherein the first, second, and third mixing panels are respectively configured to divide the fluid flow into the first portion, the second portion, and a third portion.

6. The static mixer of claim 5, wherein the first mixing baffle is configured to rotate the first, second, and third portions of the fluid flow in a first rotational direction as the fluid flow flows from the leading edge of the first mixing baffle to the trailing edge.

7. The static mixer of claim 6, wherein the mixing element further includes a second mixing baffle integral with the first mixing baffle, the second mixing baffle extending from a leading edge to a trailing edge and including a first mixing panel, a second mixing panel, and a third mixing panel, such that the each of the first, second, and third mixing panels of the second mixing baffle partially define the leading edge and the trailing edge of the second mixing baffle, wherein the first, second, and third mixing panels of the second mixing baffle are configured to divide the fluid flow into a fourth portion, a fifth portion, and a sixth portion.

8. The static mixer of claim 7, wherein the second mixing baffle is configured to rotate the fourth, fifth, and sixth portions in a second rotational direction that is opposite the first rotational direction as the fluid flow flows from the leading edge to the trailing edge of the second mixing baffle.

9. The static mixer of claim 5, wherein the first mixing panel defines a first edge and a second edge, the first edge of the first mixing panel extending from the leading edge to the second edge of the first mixing panel, and the second edge of the first mixing panel extending from the first edge of the first mixing panel to the trailing edge, wherein the first edge of the first mixing panel is configured to contact the first inner surface of the mixing conduit, and the second edge of the first mixing panel is configured to contact the second inner surface of the mixing conduit.

10. The static mixer of claim 9, wherein the second mixing panel defines a first edge and a second edge, the first edge of the second mixing panel extending from the leading edge to the second edge of the second mixing panel, and the second edge of the second mixing panel extending from the first edge of the second mixing panel to the trailing edge, wherein the first edge of the second mixing panel is configured to contact the second inner surface of the mixing conduit, and the second edge of the second mixing panel is configured to contact the third inner surface of the mixing conduit.

11. The static mixer of claim 10, wherein the third mixing panel defines a first edge and a second edge, the first edge of the third mixing panel extending from the leading edge to the second edge of the third mixing panel, and the second edge of the third mixing panel extending from the first edge of the third mixing panel to the trailing edge, wherein the first edge of the third mixing panel is configured to contact the third inner surface of the mixing conduit, and the second edge of the third mixing panel is configured to contact the first inner surface of the mixing conduit.

12. The static mixer of claim 1, wherein the first mixing baffle is configured to rotate the first and second portions of the fluid flow in a first rotational direction as the fluid flow flows from the leading edge to the trailing edge of the first mixing baffle.

13. The static mixer of claim 12, wherein the mixing element defines a second mixing baffle integral with the first mixing baffle that extends from a leading edge to a trailing edge, and the second mixing baffle is configured to divide the fluid flow into a third portion and a fourth portion.

14. The static mixer of claim 13, wherein the second mixing baffle is configured to rotate the third and fourth portions of the fluid flow in a second rotational direction that is opposite the first rotational direction as the fluid flow flows from the leading edge to the trailing edge of the second mixing baffle.

15. A method of mixing first and second components with a static mixer that includes a mixing conduit and a mixing element that includes a first mixing baffle and a second mixing baffle downstream from the first mixing baffle, the method comprising:

flowing a fluid flow through a first end of a mixing passage of the mixing conduit, wherein the mixing passage defines a first inner surface, a second inner surface that extends from the first inner surface, and a third inner surface that extends from the first inner surface to the second inner surface such that the mixing passage and the mixing element is configured to contact the first, second, and third inner surfaces and defines a substantially triangular cross-section;

flowing the fluid flow over a leading edge of the first mixing baffle to divide the fluid flow into at least two first portions;

flowing the at least two first portions, the leading edge of the first mixing baffle defined by a plurality of leading edge portions obliquely angled relative to each of the first, second, and third inner surfaces of the mixing passage of the fluid flow along the first mixing baffle to rotate the at least two first portions of the fluid flow in a first rotational direction within the mixing passage relative to a central axis defined by the mixing conduit;

recombining the at least two first portions at a trailing edge of the first mixing baffle, such that the at least two first portions form a first mixture;

flowing the first mixture over a leading edge of the second mixing baffle to divide the first mixture into at least two second portions;

flowing the at least two second portions of the first mixture along the second mixing baffle to rotate the at least two second portions of the first mixture in a second rotational direction that is opposite the first rotational direction within the mixing passage relative to the central axis; and recombining the at least two second portions of the first mixture at a trailing edge of the second mixing baffle, such that the at least two second portions of the first mixture form a second mixture.

16. The method of claim 15, wherein the first and second mixing baffles each include three mixing panels, and the at least two portions of the fluid flow includes a first portion, a second portion, and a third portion, and the at least two portions of the first mixture include a first portion, a second portion, and a third portion.

17. The method of claim 16, further comprising:

rotating the first, second, and third portions of the fluid flow in the first rotational direction; and rotating the first, second, and third portions of the first mixture in the second rotational direction.

18. The method of claim 17, further comprising:

shifting the first, second, and third portions of the fluid flow; and expanding the first, second, and third portions of the fluid flow.

19. The method of claim 16, wherein the first and second mixing baffles each include two mixing panels, and the at least two portions of the fluid flow includes a first portion and a second portion, and the at least two portions of the first mixture include a first portion and a second portion.

20. The method of claim 19, further comprising the steps of:

rotating the first and second portions of the fluid flow in the first rotational direction; and rotating the first and second portions of the first mixture in the second rotational direction.

21. The method of claim 20, further comprising:

shifting the first, second, and third portions of the fluid flow; and expanding the first, second, and third portions of the fluid flow.

* * * * *